US006193542B1

(12) United States Patent
Marowsky et al.

(10) Patent No.: US 6,193,542 B1
(45) Date of Patent: Feb. 27, 2001

(54) MODULAR ELECTRICAL PLUG AND PLUG-CABLE ASSEMBLY INCLUDING THE SAME

(75) Inventors: Richard Marowsky, York; Robert Colantuono, Dover; Ronald Locati, York, all of PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/246,165

(22) Filed: Feb. 8, 1999

Related U.S. Application Data

(60) Provisional application No. 60/110,312, filed on Nov. 30, 1998.

(51) Int. Cl.[7] ..... H01R 11/20

(52) U.S. Cl. ..... 439/418; 439/676

(58) Field of Search ..... 439/418, 676, 439/941, 620, 344, 460, 607, 701, 638, 467, 449, 455, 465

(56) References Cited

U.S. PATENT DOCUMENTS

| | | | |
|---|---|---|---|
| 4,601,530 | 7/1986 | Coldren et al. | 339/103 M |
| 4,767,355 | 8/1988 | Phillipson et al. | 439/425 |
| 5,460,545 | 10/1995 | Siemon et al. | 439/308 |
| 5,547,405 | 8/1996 | Pinney et al. | 439/894 |
| 5,571,035 | 11/1996 | Ferrill | 439/894 |
| 5,628,647 | 5/1997 | Rohrbaugh et al. | 439/404 |
| 5,634,817 | 6/1997 | Siemon et al. | 439/608 |
| 5,655,284 | 8/1997 | Ferrill et al. | 29/566.3 |
| 5,830,005 | 11/1998 | Watanabe | 439/418 |
| 5,888,100 | 3/1999 | Bofill et al. | 439/676 |
| 5,899,770 * | 5/1999 | Ezawa | 439/418 |

* cited by examiner

*Primary Examiner*—Gary F. Paumen
*Assistant Examiner*—Ross Gushi
(74) *Attorney, Agent, or Firm*—Steinberg & Raskin, P.C.

(57) ABSTRACT

Modular plug offering consistent de-embedded near-end crosstalk (NEXT) performance and terminated open circuit (TOC) values for plugs having the same design including a housing defining terminal-receiving slots and a longitudinal cavity extending from a rear surface of the housing to a location below the slots and being in communication therewith. The housing includes a strain relief element for engaging with the cable and securing the cable to the housing. The plug also includes contact terminals arranged in the slots and a load bar defining wire-receiving channels for receiving wires of the cable. The load bar is arranged in the cavity opposite the strain relief element such that the wires of the cable are fixed in position at least at a location opposite the strain relief element. The load bar is preferably hinged such that a rearward portion thereof is rotatable with respect to a forward portion thereof. This in conjunction with the dimensioning of the channels in the load bar and size of the cavity in the plug housing enables the plug to be used to terminate cables of various sizes. A plug-cable assembly including a cable terminated at one or both ends by such plugs is also disclosed as well as a method for terminating a cable with a plug.

23 Claims, 18 Drawing Sheets

| | 1 | 2 | 3 | 4 | 5 | 6 | 7 | 8 | 9 | 10 |
|---|---|---|---|---|---|---|---|---|---|---|
| TOC @ 100 Mhz | 59.8 | 68.7 | 67.6 | 75.7 | 75.9 | 77.1 | 65.7 | 76 | 69.7 | 100 |
| MIN TOC LIMIT | 55 | 55 | 55 | 55 | 55 | 55 | 55 | 55 | 55 | 55 |

| PAIR NOS. | MIN REQ. | TOC VALUE @ 100 Mhz(dB) | | | MAXIMUM VARIATION IN TOC VALUES (dB) |
|---|---|---|---|---|---|
| | | PLUG# 1 | PLUG# 2 | PLUG# 3 | |
| 4512 | 55 | 57.3 | 57.7 | 58.9 | 1.6 |
| 4536 | 40 | 39.8 | 40.8 | 41.1 | 1.3 |
| 4578 | 55 | 55.1 | 55.1 | 55.1 | 0.0 |
| 1236 | 45 | 48.3 | 48.9 | 48.4 | 0.6 |
| 1278 | 55 | 64.6 | 67.9 | 65.5 | 3.3 |
| 3678 | 45 | 47.3 | 47.6 | 47.9 | 0.6 |

| PAIR NOS. | MIN REQ. | TOC VALUE @ 100 Mhz(dB) PLUG #1 | PLUG #2 | PLUG #3 | PLUG #4 | PLUG #5 | PLUG #6 | PLUG #7 | MAXIMUM VARIATION IN TOC VALUES (dB) EXLUDING PLUG #6 |
|---|---|---|---|---|---|---|---|---|---|
| 4512 | 55 | 57.3 | 57.7 | 58.9 | 55.9 | 59.2 | 60.7 | 57.0 | 3.3 |
| 4536 | 40 | 39.8 | 40.8 | 41.1 | 41.0 | 41.8 | 47.6 | 42.2 | 2.4 |
| 4578 | 55 | 55.1 | 55.1 | 55.1 | 55.9 | 56.1 | 54.6 | 56.4 | 1.3 |
| 1236 | 45 | 48.3 | 48.9 | 48.4 | 47.7 | 48.0 | 48.8 | 47.9 | 1.2 |
| 1278 | 55 | 64.6 | 67.9 | 65.5 | 66.4 | 67.8 | 66.4 | 68.6 | 4.0 |
| 3678 | 45 | 47.3 | 47.6 | 47.9 | 49.0 | 48.9 | 48.2 | 53.0 | 5.7 |

FIG.11
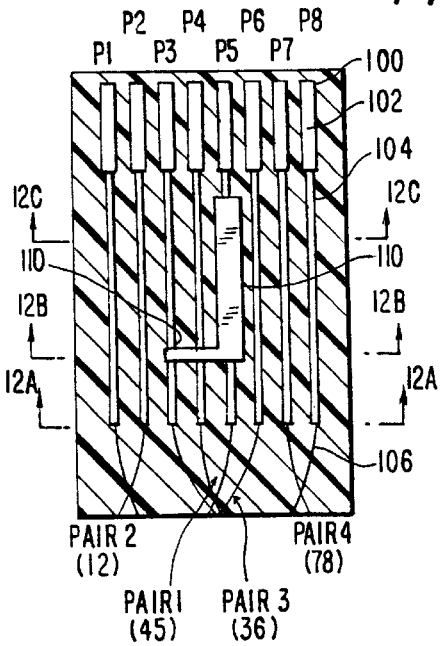
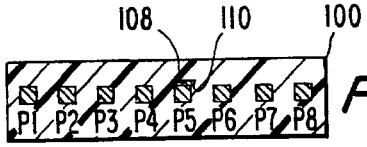
FIG.12A
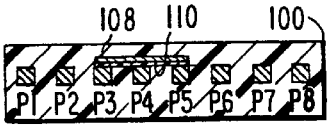
FIG.12B
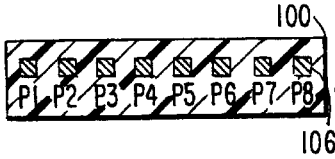
FIG.12C
FIG.13
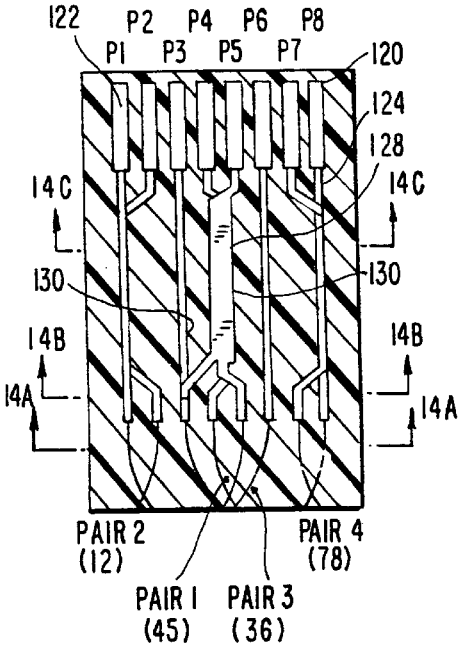
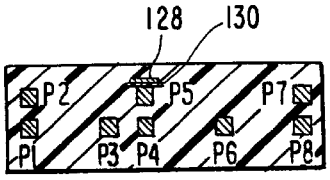
FIG.14A
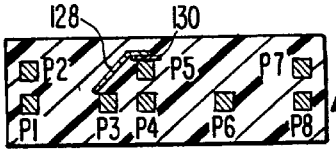
FIG.14B
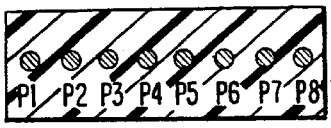
FIG.14C

| SAMPLE NO. | 45 - 12 | | 45 - 36 | | 45 - 78 | | 12 - 36 | | 12 - 78 | | 36 - 78 | |
|---|---|---|---|---|---|---|---|---|---|---|---|---|
| | DB-NEXT | TOC | DB-NEXT | TOC | DB-NEXT | TOC | DB-NEXT | TOC | DB-NEXT | TOC | DB-NEXT | TOC |
| 1 | -52.5 | -62.9 | -33.5 | -40.3 | -60.0 | -61.0 | -41.8 | -45.2 | -51.5 | -58.8 | -50.2 | -49.3 |
| 2 | -55.3 | -68.7 | -36.3 | -42.5 | -53.8 | -57.8 | -46.6 | -49.7 | -54.2 | -63.7 | -52.1 | -51.1 |
| 3 | -43.2 | -51.9 | -38.5 | -43.9 | -44.1 | -56.5 | -45.3 | -49.5 | -60.5 | -60.0 | -38.5 | -45.2 |
| 4 | -46.0 | -52.3 | -34.1 | -40.0 | -58.9 | -70.9 | -53.6 | -52.5 | -64.0 | -69.6 | -46.0 | -48.3 |
| 5 | -54.8 | -57.0 | -31.7 | -38.7 | -51.2 | -59.3 | -65.1 | -54.1 | -64.2 | -65.9 | -41.9 | -46.4 |
| 6 | -52.7 | -59.5 | -35.5 | -41.9 | -51.7 | -56.2 | -49.3 | -50.2 | -79.1 | -77.7 | -45.5 | -48.7 |
| 7 | -58.9 | -63.2 | -38.7 | -44.9 | -58.9 | -62.9 | -47.4 | -49.0 | -66.7 | -64.1 | -43.4 | -46.6 |
| 8 | -53.1 | -67.4 | -36.1 | -42.2 | -45.0 | -53.4 | -46.2 | -48.4 | -72.1 | -77.0 | -46.6 | -47.6 |
| 9 | -59.3 | -66.5 | -37.8 | -43.6 | -42.0 | -50.1 | -45.5 | -47.9 | -52.2 | -57.7 | -50.6 | -50.6 |
| 10 | -48.6 | -55.2 | -36.9 | -42.2 | -52.7 | -59.6 | -40.8 | -45.0 | -72.4 | -70.9 | -44.5 | -47.1 |
| | | | | | | | | | | | | |
| | | | | | | | | | | | | |

FIG. 15

| NEXT STATS: | | 4512 | 4536 | 4578 | 1236 | 1278 | 3678 | |
|---|---|---|---|---|---|---|---|---|
| | MIN | 43.2 | 31.7 | 42.0 | 40.8 | 51.5 | 38.5 | (dB) |
| | MAX. | 59.3 | 38.7 | 60.0 | 65.1 | 79.1 | 52.1 | (dB) |
| | DELTA | 16.1 | 7.1 | 18.0 | 24.3 | 27.6 | 13.7 | (dB) |

FIG. 16

| TOC STATS: | | 4512 | 4536 | 4578 | 1236 | 1278 | 3678 | |
|---|---|---|---|---|---|---|---|---|
| | MIN | 51.9 | 38.7 | 50.1 | 45.0 | 57.7 | 45.2 | (dB) |
| | MAX. | 68.7 | 44.9 | 70.9 | 54.1 | 77.7 | 51.1 | (dB) |
| | DELTA | 16.8 | 6.2 | 20.9 | 9.1 | 19.9 | 5.9 | (dB) |

FIG. 17

| SAMPLE NO. | 45 - 12 | | 45 - 36 | | 45 - 78 | | 12 - 36 | | 12 - 78 | | 36 - 78 | |
|---|---|---|---|---|---|---|---|---|---|---|---|---|
| | DB-NEXT | TOC | DB-NEXT | TOC | DB-NEXT | TOC | DB-NEXT | TOC | DB-NEXT | TOC | DB-NEXT | TOC |
| SLIT 1 | -51.6 | -60.3 | -34.3 | -41.0 | -49.2 | -56.9 | -44.2 | -48.3 | -81.8 | -78.5 | -42.9 | -47.0 |
| SLIT 2 | -51.1 | -60.0 | -35.6 | -42.5 | -47.8 | -56.6 | -43.1 | -46.7 | -79.8 | -77.5 | -45.2 | -48.4 |
| SLIT 3 | -51.8 | -60.4 | -34.3 | -41.4 | -49.5 | -58.1 | 43.3 | -47.2 | -80.6 | -82.3 | -43.5 | -47.2 |
| SLIT 4 | -51.1 | -59.3 | -33.7 | -40.7 | -49.8 | -57.8 | -43.0 | -48.5 | -78.0 | -79.9 | -43.0 | -47.0 |
| SLIT 5 | -50.8 | -59.1 | -34.2 | -41.2 | -48.5 | -55.5 | -43.2 | -47.1 | -81.4 | -76.6 | -43.0 | -46.8 |
| SLIT 6 | -49.7 | -58.0 | -35.4 | -42.3 | -48.2 | -56.7 | -43.7 | -47.1 | -82.7 | -78.3 | -43.7 | -47.5 |
| SLIT 7 | -51.8 | -60.7 | -33.6 | -40.8 | -49.8 | -58.1 | -43.1 | -46.4 | -78.8 | -76.3 | -42.3 | -46.3 |
| SLIT 8 | -50.3 | -58.5 | -33.6 | -40.6 | -48.9 | -56.1 | -43.8 | -49.7 | -82.9 | -81.3 | -43.4 | -47.4 |
| SLIT 9 | -50.8 | -59.2 | -33.9 | -41.0 | -49.6 | -57.8 | -44.0 | -47.2 | -78.6 | -77.0 | -42.2 | -46.3 |
| SLIT 10 | -50.5 | -59.0 | -33.4 | -40.2 | -48.7 | -56.1 | -43.4 | -46.4 | -79.7 | -77.1 | -43.1 | -47.1 |
| SLIT 11 | -51.0 | -59.6 | -33.7 | -40.8 | -48.8 | -55.8 | -43.0 | -46.5 | -79.6 | -76.3 | -42.9 | -46.8 |
| SLIT 12 | -50.3 | -58.3 | -33.7 | -40.8 | -49.7 | -57.1 | -42.8 | -46.3 | -79.3 | -76.1 | -43.3 | -47.3 |

FIG. 27

| NEXT STATS: | | 4512 | 4536 | 4578 | 1236 | 1278 | 3678 | |
|---|---|---|---|---|---|---|---|---|
| | MIN | 49.74 | 33.38 | 47.81 | 42.82 | 42.82 | 42.20 | (dB) |
| | MAX. | 51.77 | 35.58 | 49.80 | 44.17 | 44.17 | 45.17 | (dB) |
| | DELTA | 2.03 | 2.19 | 1.98 | 1.36 | 1.36 | 2.97 | (dB) |

FIG. 28

| TOC STATS: | | 4512 | 4536 | 4578 | 1236 | 1278 | 3678 | |
|---|---|---|---|---|---|---|---|---|
| | MIN | 58.02 | 40.19 | 55.50 | 46.34 | 76.08 | 46.33 | (dB) |
| | MAX. | 60.67 | 42.54 | 58.09 | 49.73 | 82.29 | 48.40 | (dB) |
| | DELTA | 2.66 | 2.35 | 2.59 | 3.40 | 6.21 | 2.07 | (dB) |

FIG. 29

MODULAR ELECTRICAL PLUG AND PLUG-CABLE ASSEMBLY INCLUDING THE SAME

This application claims priority of U.S. provisional patent application Ser. No. 60/110,312 filed Nov. 30, 1998.

FIELD OF THE INVENTION

This invention relates generally to electrical connectors and, more particularly, to multi-position modular plugs offering consistent near end crosstalk ("NEXT") performance, i.e., NEXT values between wire pairs for plugs having the same design are substantially the same, and TOC (terminated open circuit) performance, i.e., TOC values between wire pairs for plugs having the same design are substantially the same. TOC performance relates to capacitive near-end crosstalk so that NEXT performance, which relates to both capacitive and inductive crosstalk, encompasses TOC performance.

The modular plugs in accordance with the invention may be used, depending on the construction, as Category 5, Category 5E or Category 6 plugs.

The present invention also relates to assemblies of the modular plug and a multi-wire cable terminated at one end by the plug and at the other end by another plug or another electrical connector.

BACKGROUND OF THE INVENTION

Data communication networks are being developed which enable the flow of information to ever greater numbers of users at ever higher transmission rates. However, data transmitted at high rates in multi-pair data communication cables have an increased susceptibility to crosstalk, which often adversely affects the processing of the transmitted data. Crosstalk occurs when signal energy inadvertently "crosses" from one signal pair to another. The point at which the signal crosses or couples from one set of wires to another may be 1) within the connector or internal circuitry of the transmitting station, referred to as "near-end" crosstalk, 2) within the connector or internal circuitry of the receiving station, referred to as "far-end crosstalk", or 3) within the interconnecting cable.

Near-end crosstalk ("NEXT") is especially troublesome in the case of telecommunication connectors of the type specified in sub-part F of FCC part 68.500, commonly referred to as modular connectors. The EIA/TIA (Electronic/Telecommunication Industry Association) of ANSI has promulgated electrical specifications for near-end crosstalk isolation in network connectors to ensure that the connectors themselves do not compromise the overall performance of the unshielded twisted pair (UTP) interconnect hardware typically used in LAN systems. The EIA/TIA Category 5 electrical specifications specify the minimum near-end crosstalk isolation for connectors used in 100 ohm unshielded twisted pair Ethernet type interconnects at speeds of up to 100 MHz.

A typical modular jack includes a housing having a cavity therein of a size for receiving a modular plug, where the cavity is provided with a plurality of cantilevered spring contacts which correspond to a like plurality of contact terminals in the mating modular plug. The modular plug receives discrete, insulated, stranded or solid conductors in conductor-receiving channels or slots formed in a dielectric housing. Flat, blade-like metallic terminals are then inserted into individual vertically oriented slots in the housing in a generally side-by-side arrangement with contact portions thereof extending into engagement with the conductors.

When the plug is inserted into a modular jack, the cantilevered portions of the terminals in the jack engage portions of associated terminals in the plug.

The characteristics of Category 5 plugs must be verified to conform with FCC standard ANSI/TIA/EIA-568-A by measuring near-end crosstalk loss between the unshielded twisted pair conductor combinations when the plug is in an unmated state, i.e., when there is no current flow through the plug. This measurement is sometimes referred to as a "terminated open circuit" or TOC test.

In an eight-position modular plug, the contacts and twisted wires are numbered from 1 to 8, from left to right with the contacts facing upward. Wires 4 and 5 form signal pair number 1, i.e., they are operatively electrically coupled in an electrical circuit, wires 1 and 2 form signal pair number 2, wires 3 and 6 form signal pair number 3 and wires 7 and 8 form signal pair number 4. In this case, the TOC test is performed on the six different twisted pair conductor/wire combinations, namely the combinations of signal pair numbers 1 and 2, 1 and 3, 1 and 4,2 and 3,2 and 4, and 3 and 4.

To conduct the TOC test, the apparatus shown in FIG. 1 is used. A 100 Ω resistor 10 is connected in parallel with the 100 Ω test leads 12 (where they connect to the wideband baluns 14) and NEXT is measured by the network analyzer 16. The measured NEXT loss at 100 MHz must be in the range shown in Table 1.

TABLE 1

| Wire Pair Combination | Test Plug NEXT loss at 100 MHz |
|---|---|
| 1 and 2 | ≧55 dB |
| 1 and 3 | ≧40 dB |
| 1 and 4 | ≧55 dB |
| 2 and 3 | ≧45 dB |
| 2 and 4 | ≧55 dB |
| 3 and 4 | ≧45 dB |

In addition, for wire pair combination 1 and 3, the difference between the NEXT loss measured at 100 MHz and the NEXT loss measured at 10 MHz must be 20 ±0.5 dB. Additional TOC requirements for wire pair combination 1 and 3 of the test plugs include: at least one of the test plugs must exhibit NEXT loss in the range of ≧ 40.0 dB to <40.5 dB at 100 MHz; at least one of the test plugs must exhibit NEXT loss in the range of ≳ 40.5 dB to <41.5 dB at 100 MHz; and at least one of the test plugs must exhibit NEXT loss in the range of ≧ 41.5 dB at 100 MHz;

Conventional modular plugs include one or more load bars for receiving the conductors in separate conductor-receiving passages. The use of load bars contributes to control of the inter-conductor capacitance in the plug. FIG. 2 shows typical TOC values measured for ten eight-position modular plugs of the same design between the pair combination 2 and 4, specifically, an RJ45 plug having two load bars terminating a 24 AWG Tinned Stranded UTP cable made by Lucent Technologies. As shown in FIG. 2, for eight-position modular plugs having the same design, TOC values can vary by as much as 40 dB between plugs (compare test plugs 1 and 10). This variation is partially due to the relatively random arrangement of the unshielded twisted pairs (UTP) of conductors in the body of the plug, i.e., in the wire-receiving channels in the plug body, which causes small changes in the capacitance between the conductors.

One way to reduce inter-conductor capacitance in a plug is by offsetting adjacent conductors. Examples of this type of plug are disclosed in U.S. Pat. No. 5,628,647 (Rohrbaugh et al.) wherein the conductors are arranged in two planar arrays spaced one above the other. The offset conductors helps lower the plug's internal capacitance but does not result in stable TOC values for plugs having the same design.

In another attempt to stabilize the capacitance in an RJ45 plug in order to obtain consistent TOC values for plugs having the same design, three plugs 20 were assembled with four load bars 22 each (FIG. 3). The plugs initially were a standard RJ45 plug manufactured by Stewart Connector Systems but modified to include four load bars, and as tested, terminate a Berk-Tek Lan-Mark-350 cable (the same cable is used in all of the TOC tests described herein unless stated to the contrary). The use of four load bars fixed the inter-conductor capacitance within the length of the body of the plug. TOC measurements were then made on each pair combination to determine the degree of TOC stability. As shown in FIG. 4, the TOC values measured on the three plugs using four load bars each had less than a 4 dB variation from plug to plug.

Although the measured TOC values for a four-load bar plug as shown in FIG. 4 exhibits less variation from plug to plug than a standard Category 5, eight-position modular plug using two load bars, the wire pair combination 1 and 3 does not always yield a TOC value that complies with the requirements of TIA/EIA-568A. Indeed, the lowest TOC value obtained in the three plugs tested is 39.8 dB between the wire pair combination 1 and 3. However, the minimum requirement for pair combination 1 and 3 is 40 dB (See Table 1) and thus these modified plugs would not pass the TOC test according to ANSI standard EIA/TIA-568-A.

With respect to NEXT values (a measure of both capacitive and inductive crosstalk) between wire pairs of plugs, it has been found that variations in NEXT values between plugs of the same design are caused at least in part by the random arrangement of the UTP wires underneath the plug's strain relief element. That is, the strain relief element in typical plugs engages with a shielded cable at a location prior to unsheathing of the cable and thus prior to insertion of the wires in positioning channels in the plug (e.g., in a load bar of the plug) and therefore, the UTP wires are arranged in the cable underneath the strain relief element in an arbitrary, random manner. It has also been found that TOC values between wire pairs also vary in view of the random nature of the arrangement of the wires in the cable below the strain relief element. In this regard, FIG. 15 shows a table of the results of tests performed on ten (10) different plugs of a model of an RJ45 Category 5 plug manufactured by the assignee hereof for both NEXT values and TOC values for all of the combinations of wire pairs (e.g., wire pair 1 to wire pair 2 is represented by 45–12). The measurement of NEXT is "de-embedded" NEXT, i.e, the crosstalk of a mating plug and jack is measured and the crosstalk of the jack is subtracted therefrom so that the resultant value is only the crosstalk caused by the construction of the plug. FIG. 16 is a table of maximum, minimum and variation in de-embedded NEXT values based on the data in the table of FIG. 15. As seen in FIG. 16, the variation in de-embedded NEXT values (delta) ranges from 7.1 dB to 27.6 dB. FIG. 17 is a table of maximum, minimum and variation in TOC values based on the data in the table of FIG. 15. As seen in FIG. 17, the variation in TOC values (delta) ranges from 5.9 dB to 20.9 dB. It would be beneficial to reduce the extent of these variations in de-embedded NEXT values and TOC values since variations in NEXT and TOC values could result in adverse operational performance of the plug.

OBJECTS AND SUMMARY OF THE INVENTION

It is an object of the present invention to provide new and improved modular plugs and modular plug-cable assemblies including the same.

It is another object of the present invention to provide new and improved multi-position modular Category 5, Category 5E and Category 6 plugs offering consistent NEXT and TOC values between plugs of the same design.

It is another object of the present invention to provide new and improved multi-position modular Category 5 plugs satisfying ANSI standard TIA/EIA-568A and offering consistent NEXT and TOC values between plugs of the same design.

It is another object of the present invention to provide new and improved multi-position modular Category 5 plugs satisfying ANSI standard TIA/EIA-568A and offering consistent NEXT and TOC values wherein the deviation in NEXT and TOC values between plugs of the same design is typically of an order of ±1.5 dB.

It is still another object of the invention to provide new and improved plugs having the ability to terminate different cables which have cable jackets and wires of different sizes and plug-cable assemblies formed from such plugs and cables.

Briefly, in accordance with the present invention, these and other objects are achieved by providing a modular plug including a housing made of dielectric material including a plurality of parallel, spaced, longitudinally extending terminal-receiving slots at a forward end and a longitudinal cavity extending from a rear face thereof forward to a location below the slots such that the cavity is in communication with the slots. Each terminal-receiving slot receives a respective contact terminal or contact blade, e.g., an insulation displacing contact. The plug also includes a management or load bar (hereinafter referred to only as a load bar) which is inserted into the cavity and is preferably longitudinally coextensive with the cavity. The load bar defines wire-receiving channels in two substantially parallel rows. The wire-receiving channels are staggered in relationship to one another. To terminate a multi-wire cable by the plug, the cable jacket of the cable is slit to expose a length of the wires. The wires are inserted into the wire-receiving channels of the load bar, which are formed to enable secure retention of the wires. A portion of the upper section of the slit cable jacket is cut so that a remaining portion has a sufficient length to overlie a rearward portion of the load bar which includes the location at which the strain relief element of the plug will be crimped. Similarly, a portion of the lower section of the slit cable jacket is cut so that a remaining portion has a length sufficient to underlie the rearward portion of the load bar. The load bar, with the overlying and underlying portions of the cable jacket, is then inserted into the cavity in the plug housing. Contact terminals in the terminal-receiving slots are pressed into the wires to pierce the insulation of the wires and engage the metal wire therein. The strain relief element on the plug is then crimped to engage the cable jacket overlying the rearward portion of the load bar and securely fix the cable in the plug.

In this manner, the wires are in pre-determined positions below the strain relief element to thereby avoid any randomness in the arrangement of the wires in the plug. As a result, variations in NEXT and TOC values between wire pairs in plugs having substantially the same design are significantly reduced.

BRIEF DESCRIPTION OF THE DRAWINGS

A more complete appreciation of the present invention and many of the attendant advantages thereof will be readily understood by reference to the following detailed description when considered in connection with the accompanying drawings in which:

FIG. 11 is a cross-sectional view of another embodiment of a plug in accordance with the invention including lead frames;

FIG. 12A is a cross-sectional view taken along the line 12A—12A of FIG. 11;

FIG. 12B is a cross-sectional view taken along the line 12B—12B of FIG. 11;

FIG. 12C is a cross-sectional view taken along the line 12C—12C of FIG. 11;

FIG. 13 is a cross-sectional view of another embodiment of a plug in accordance with the invention including lead frames;

FIG. 14A is a cross-sectional view taken along the line 14A—14A of FIG. 13;

FIG. 14B is a cross-sectional view taken along the line 14B—14B of FIG. 13;

FIG. 14C is a cross-sectional view taken along the line 14C—14C of FIG. 13;

FIG. 15 is a table of measured de-embedded NEXT values and TOC values between all of the pair combinations for ten different samples of a model of an RJ45 Category 5 plug;

FIG. 16 is a table of maximum, minimum and variation in NEXT values based on the table of FIG. 15;

FIG. 17 is a table of maximum, minimum and variation in TOC values based on the table of FIG. 15;

FIG. 27 is a table of measured de-embedded NEXT values and TOC values between all of the pair combinations for twelve different samples of a Cat 5E plug having a similar construction to the plug shown in FIG. 18;

FIG. 28 is a table of maximum, minimum and variation in NEXT values based on the table of FIG. 27;

FIG. 29 is a table of maximum, minimum and variation in TOC values based on the table of FIG. 27;

DETAILED DESCRIPTION OF THE PREFERRED EMBODIMENT

Figure 1:
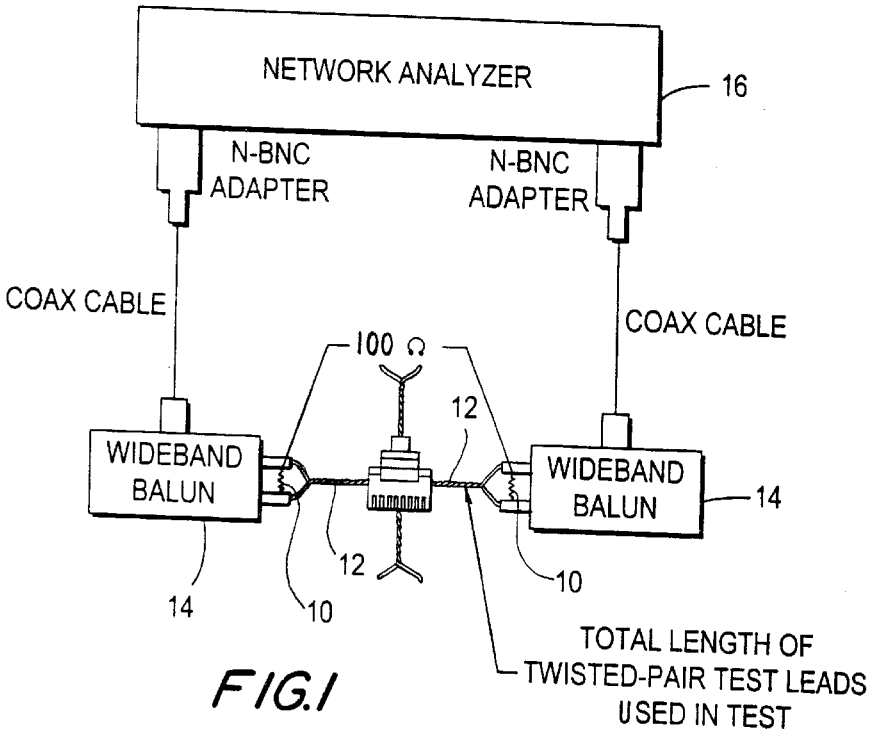
FIG. 1 is a schematic illustration of an apparatus for conducting TOC tests on multi-position modular plugs.
Figure 2:
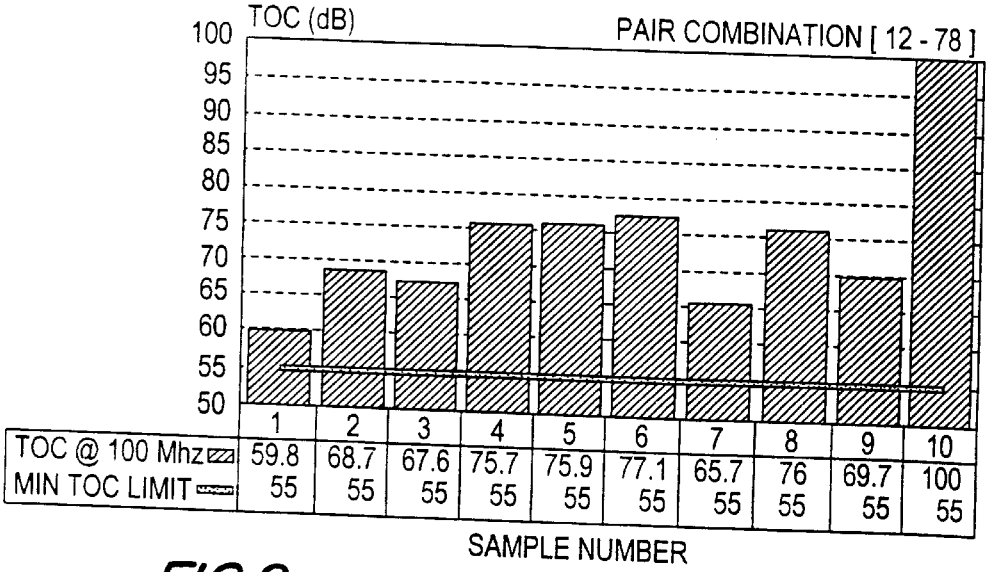
FIG. 2 shows TOC values measured between the pair combination 2 and 4 for ten eight-position RJ45 modular plugs of the same design manufactured by Stewart Connector Systems, Inc. and including two load bars.
Figures 3, 4:
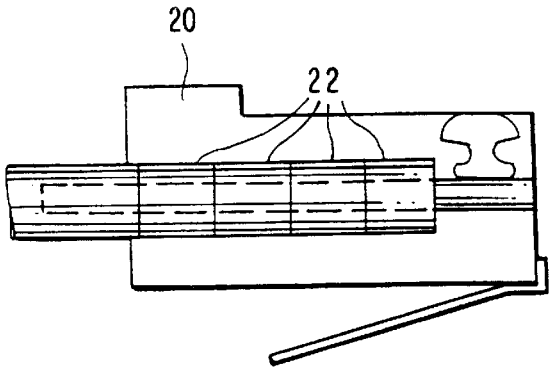
FIG. 3 shows a plug manufactured by Stewart Connector Systems modified to include four load bars.
FIG. 4 shows TOC values measured for three plugs of the type shown in FIG. 3.
Figure 5:
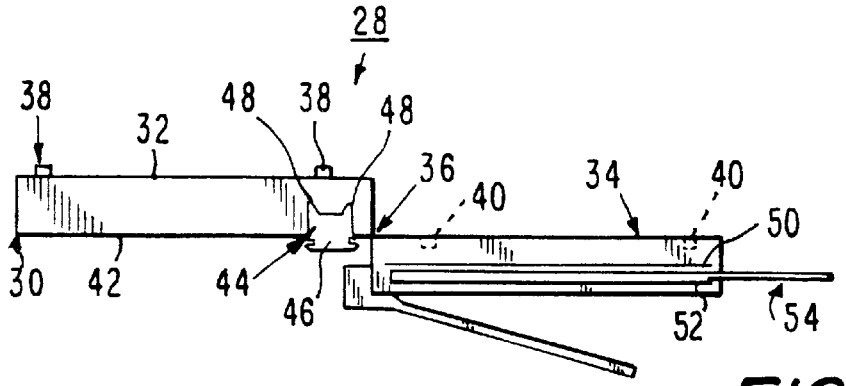
FIG. 5 is a schematic view of a plug in accordance with the invention in an open position.
Figure 6:
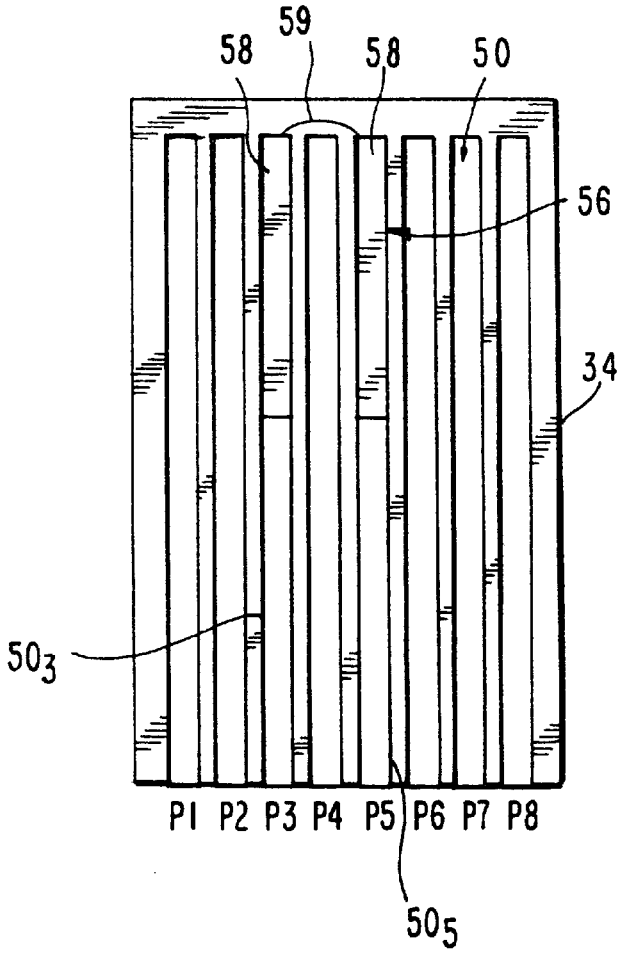
FIG. 6 is a top view of the lower frame part of the plug shown in FIG. 5 prior to insertion of wires into wire-receiving channels thereof.
Figure 7:
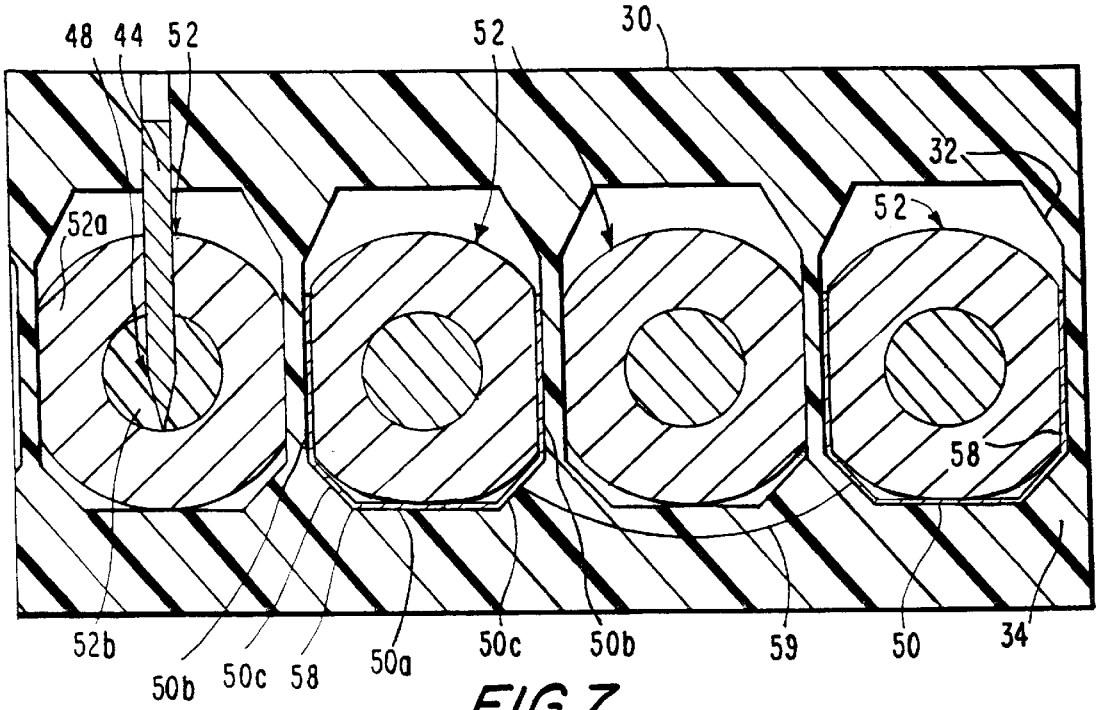
FIG. 7 is a cross-sectional view of the plug in accordance with the invention shown in FIG. 5 but in a closed position.

Referring now to the drawings wherein like reference characters designate identical or corresponding parts throughout the several views, and more particularly to FIGS. 5–7, a multi-position modular plug in accordance with the present invention is designated generally as 28 and comprises a plug housing 30 having an upper frame part 32, a lower frame part 34 and a hinge 36 pivotally connecting the upper frame part 32 to the lower frame part 34 so that the upper frame part 32 is pivotable about the hinge 36 into connection with the lower frame part 34. Connector latches 38 are provided in the upper frame part 32 and adapted to engage with corresponding recesses 40 in the lower frame part 34 when the upper frame 32 is pivoted about hinge 36 to secure the upper frame part 32 and lower frame part 34 together.

The upper frame part 32 includes a plurality of parallel, spaced-apart, longitudinally extending terminal receiving slots 41 formed through the lower surface 42 of the upper frame part 32 (when in the open position shown in FIG. 5), each of which receives a respective contact terminal or contact blade 44. Each contact blade 44 is made of an electrically conductive material and includes a flat conductive portion 46 having a pair of insulation-piercing tines 48.

The lower frame part 34 includes a plurality of wire-receiving channels 50, each arranged to receive an unshielded wire portion 52 of one of the wires of a multi-wire cable 54 terminated by the plug 30. As shown in FIG. 7, each wire-receiving channel 50 has a flat, horizontal bottom surface 50*a*, opposed vertical side surfaces 50*b* and inclined surfaces 50*c* extending between the bottom surface 50*a* and the side surfaces 50*b*. Other surface formations of the channels 50 may be used in accordance with the invention without deviating from the scope and spirit thereof. The terminal-receiving slots 41 in the upper frame part 32 are arranged relative to the wire-receiving channels 50 in the lower frame part 34 so that when the upper frame part 32 is pivoted about hinge 36, the tines 48 of the contact blades 44 penetrate through the insulation sheath 52*a* of a wire 52 in a respective wire-receiving channel 50 into contact with the core 52*b* therein. Also, at this time, the latches 38 engage with the recesses 40 to connect the upper and lower frame parts 32,34.

The plug described above is but one application of the invention and the invention may be used in conjunction with other plugs. Also, a plug in accordance with the invention may terminate each end of a cable having any number of wires, although the description herein relates generally to an eight-position modular plug. Although the channels 50 are shown in a single planar array, it is possible to form the channels 50 in two or more planar arrays, in which case, the size of the contact blades 44 is adjusted to ensure penetration of the tines 48 of the contact blades 44 through the insulation sheath of all of the wires. Also, although the channels are shown formed in the lower frame part 34, it is possible to provide the lower frame part with a recess and form the channels in a member such as load bar separate from the lower frame part and insertable into the recess of the lower frame part.

In accordance with the invention, the plug 28 includes means 56 for developing a capacitance between a wire forming part of one signal pair which is received in one wire-receiving channel 50 and a wire forming part of another signal pair which is received in another wire-receiving channel 50. This development or increase in capacitance between the wires in the wire-receiving channels improves the TOC performance between the associated signal pairs, i.e., those formed in part by the wires received in these wire-receiving channels, and specifically makes it more consistent when measured for plugs having the same design. In one embodiment, the capacitance developing means 56 comprise an electrically conductive material, such as a trace of copper foil 58 as shown in FIGS. 6 and 7, arranged in the wire-receiving channels 50 at each of positions P3 and P5, designated $\mathbf{50}_3$ and $\mathbf{50}_5$, respectively, and a electrical lead 60 connecting the foil traces 58 and situated within the lower frame part 34. The copper foil traces 58 overlie the bottom surface 50*a*, side surfaces 50*b* and inclined surfaces 50*c* of the wire-receiving channels $\mathbf{50}_3$ and $\mathbf{50}_5$ and directly engage the insulation sheath 52*a* but do not contact the core 52*b* and therefore do not affect the data transmission. Although, to obtain advantages of the invention, the foil traces 58 may overlie only one of the surfaces 50*a*,50*b*, 50*c*. The capacitance operatively developed between the wires in the wire-receiving channels $\mathbf{50}_3$ and $\mathbf{50}_5$ would be in the order of about 0.2–0.6 picofarads and would improve the TOC values, vis-a-vis the consistency thereof from plug to plug, for the wire combination 1 and 3 (the wire in channel $\mathbf{50}_3$ being in wire pair 3 whereas the wire in channels $\mathbf{50}_5$ is in wire pair 1). The magnitude of the capacitance depends on the dimensions, e.g., length, of the foil trace 58 in each wire-receiving channel $\mathbf{50}_3$ and $\mathbf{50}_5$.

Although wire-receiving channels $\mathbf{50}_3$ and $\mathbf{50}_5$ are electrically connected together in the embodiment illustrated in FIGS. 5–7 to improve the TOC values for the wire combination 1 and 3, an improvement in TOC values for other wire combinations can be obtained by electrically connecting any two wire-receiving channels in the plug which receive wires belonging to different signal pairs. Moreover, an improvement in multiple wire combinations can be obtained by electrically connecting more than one pair of wire-receiving channels together.

Instead of the foil traces 58, it is possible to provide the electrically conductive material in the wire-receiving channels by selectively plating an area of each wire-receiving channel $\mathbf{50}_3$ and $\mathbf{50}_5$ and connecting the plated areas to each other through an electrical lead extending through the lower frame part. In the alternative, it is possible to incorporate into the lower frame part 34, metallized plastic to form at least a portion of each wire-receiving channel $\mathbf{50}_3$ and $\mathbf{50}_5$ and electrically couple the metallized plastic portions together.

Figures 8, 9:
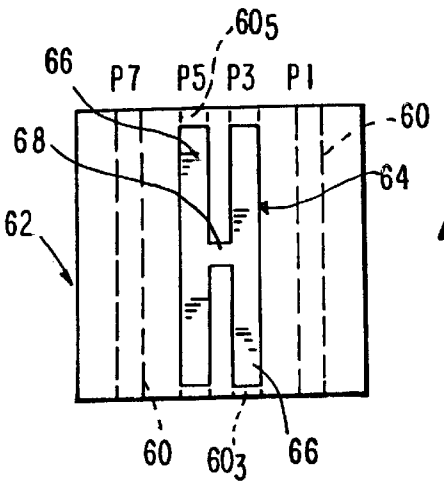
FIG. 8 shows a load bar for use in another embodiment of a plug in accordance with the invention.
FIG. 9 shows the deviation in measured TOC values between all of the pair combinations for the plug including the load bar shown in FIG. 8.
Figure 18:
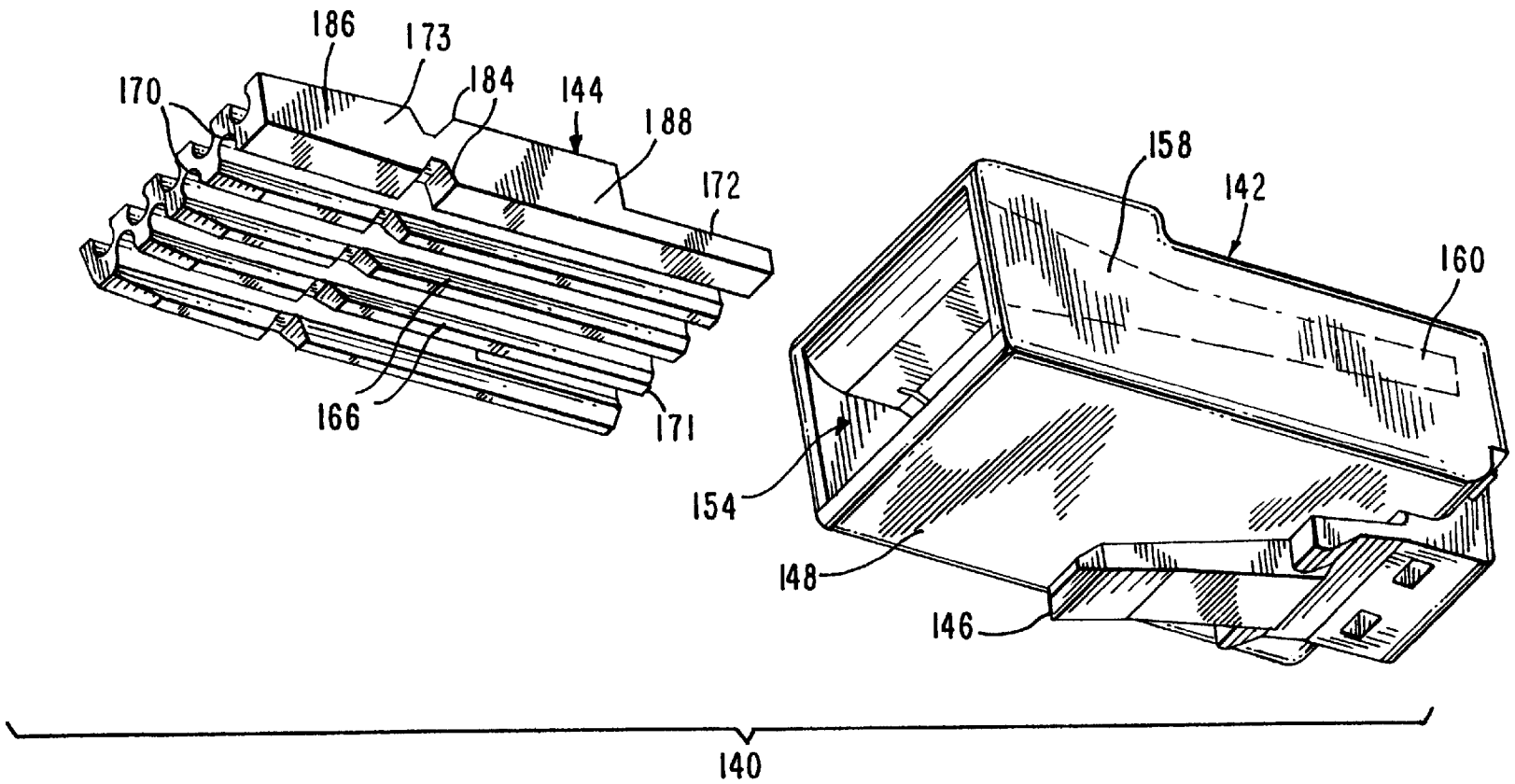
FIG. 18 is an exploded perspective view of a plug in accordance with another embodiment of the invention which provides reduced variations in NEXT and TOC values.
Figure 19:
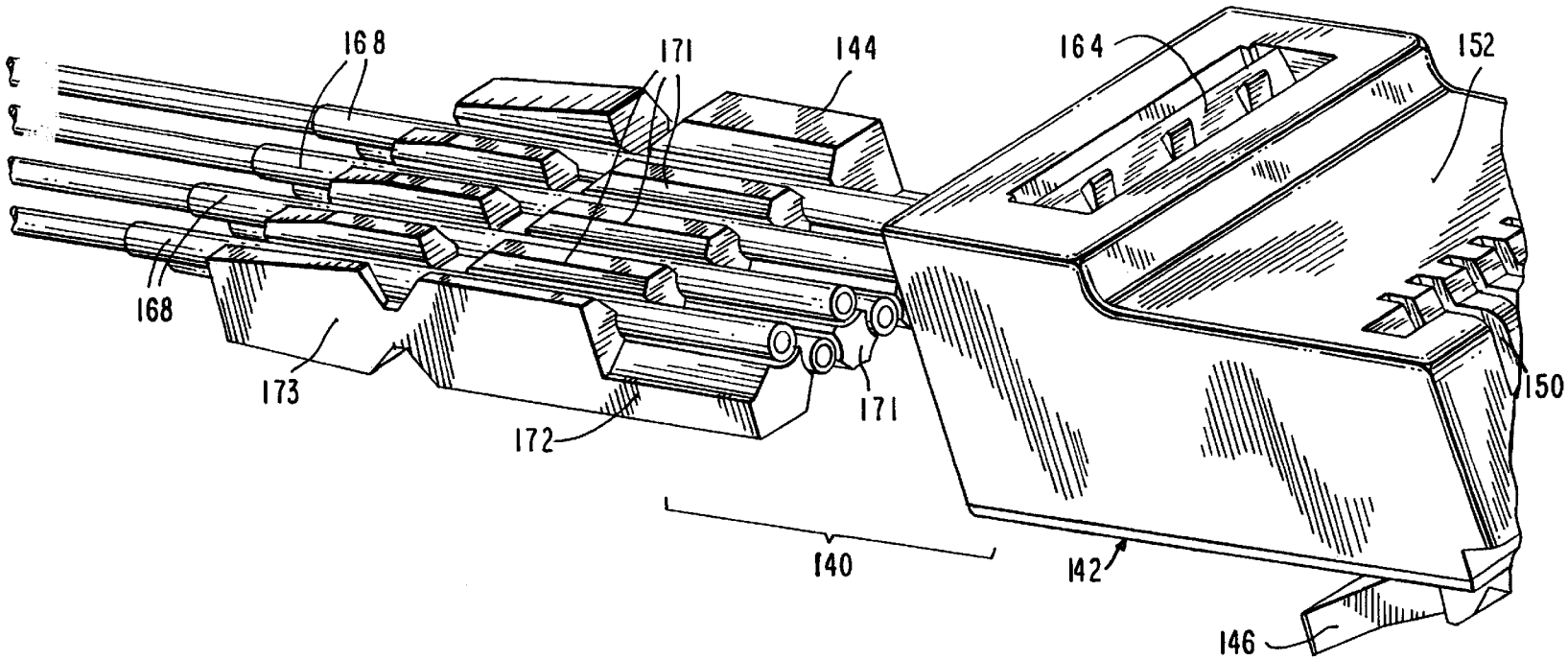
FIG. 19 is an exploded perspective view of the plug of FIG. 18 showing the wires inserted into the load bar of the plug.
Figure 20:
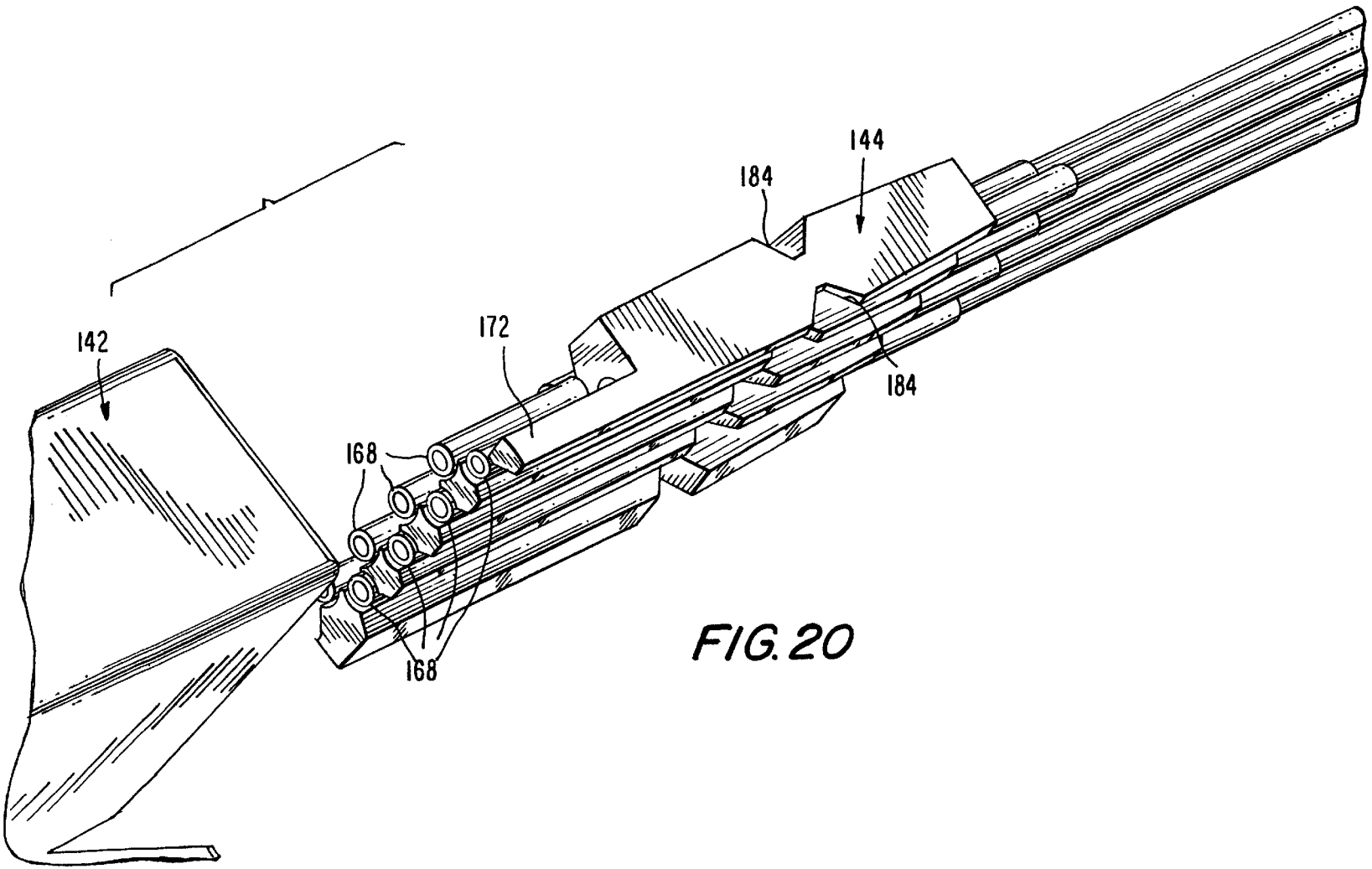
FIG. 20 is another exploded perspective view of the plug of FIG. 18.
Figure 21:
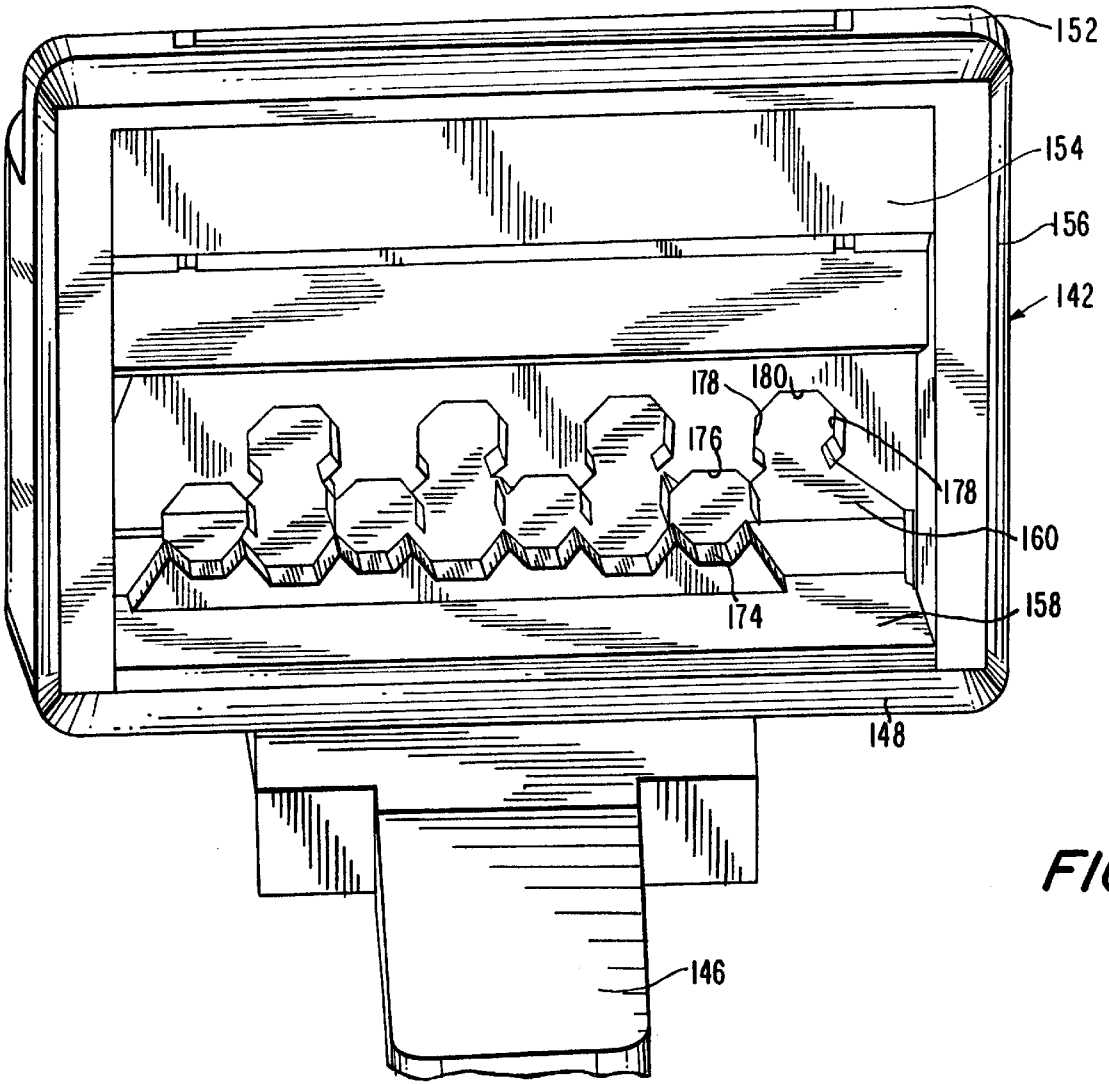
FIG. 21 is a rear view of the housing of the plug of FIG. 18.

In another embodiment of a plug in accordance with the invention, the plug includes a housing defining a longitudinal cavity, terminal-receiving slots at a front end into which contact terminals are arranged, channels for receiving wires of a multi-wire cable, each channel in communication with a respective one of the slots, a latch and a strain relief element. In accordance with the invention, the plug includes a load bar 62 as shown in FIG. 8 arranged in the longitudinal cavity and having wire-receiving channels 60 arranged in two planar arrays, such as in U.S. Pat. No. 5,628,647 discussed above, and capacitance developing means 64 for developing a capacitance between the wires in the wire-receiving channels at positions P3 and P5, designated $\mathbf{60}_3$ and $\mathbf{60}_5$. The capacitance developing means 64 comprise a foil trace 66 arranged on a surface of the load bars 62 over substantially all of wire-receiving channels $\mathbf{60}_3$ and $\mathbf{60}_5$ and a foil trace 68 spanning the gap between the foil traces 66 to thereby form an H-shaped foil trace pattern on the load bar 62. It is also possible to provide metallized plastic portions in the load bar 62 as discussed above.

The wire-receiving channels 60 are in alignment with the channels in the plug housing so that the wires pass through the load bar and enter into the channels in the plug housing whereby the portion in the channels in the plug housing is pierced by the respective contact terminal. In the alternative, it is possible to extend the longitudinal cavity up to below the slots so that the load bar extends up to below the slots, and provide openings in the load bar to enable penetration by the contact terminals in the slots of the wires retained by the load bar.

FIG. 9 shows TOC values between all the pair combination 1 and 2 for a plug as described above with reference to FIG. 8 (except that instead of a unitary load bar, four smaller identical load bars were used) in which the plug terminates a Berk-Tek Lan-Mark-350 UTP cable. Six plugs were tested and TOC values measured for each plug. The deviations are also shown in FIG. 9.

Figure 10:
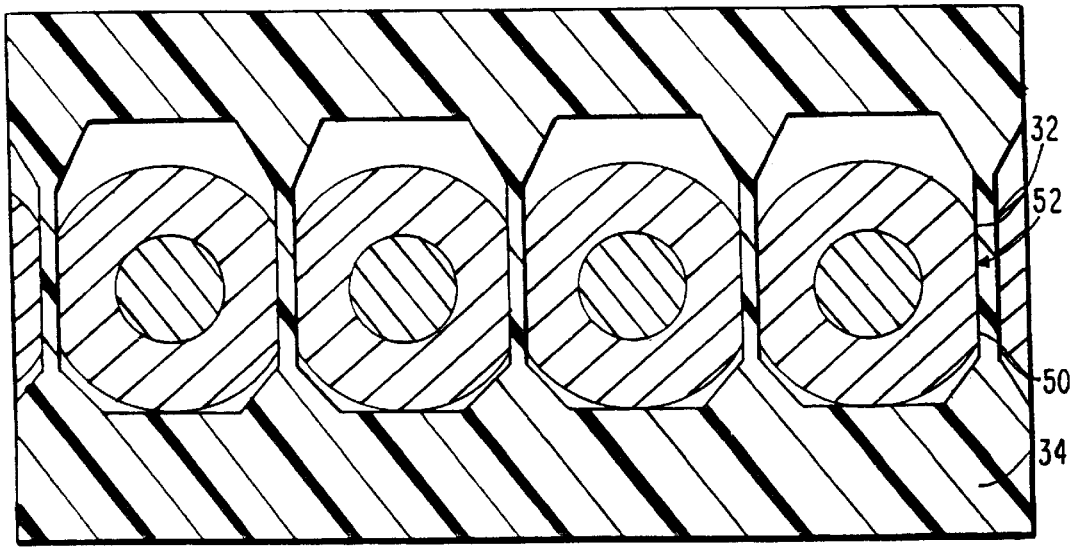
FIG. 10 is a cross-sectional view of a prior art eight-position modular plug; showing four compete wire-receiving channels

To compare TOC values for a plug in accordance with the invention as shown in FIG. 6 and a standard prior art plug without capacitance developing means (a cross-sectional view of such a plug showing four complete wire-receiving channels is shown in FIG. 10), a computer-generated electrical analysis simulation was performed for each plug. It was found that the TOC value for the wire combination 1 and 3 was 37.9 dB for the prior art plug, which is below the required minimum according to ANSI standard EIA/TIA-568-A, whereas the TOC value for the same wire combination was 44.3 dB for the plug in accordance with the invention, above the minimum requirement.

FIGS. 11–12C show a cross-section of a plug housing 100 having eight lead frames 104 at positions designated P1–P8, each lead frame 104 includes an integral plug interface blade 102. An insulation displacing contact (IDC) 106 is coupled to each lead frame 104 and a respective wire is connected to each IDC 106, e.g., by staking the wire to a bottom of the IDC 106. An electrically conductive material 108 is connected to lead frame 104 at position P3 and extends over a length portion of and at a distance from the lead frame 104 at position P5 to thus form an L-shape (FIG. 13). The electrically conductive material 108 also extends over a portion of the lead frame 104 at position P4 and is spaced therefrom. A substrate of insulating material 110 is arranged between the electrically conductive material 108 and the lead frames 104 at least at position P5 (also position P4 in the illustrated embodiment) so that the electrically conductive material 108 is not electrically connected to the lead frame 104 at position P5. By means of this construction, compensation capacitance is developed between the lead frames 104 at positions P3 and P5 thereby improving TOC performance measured between the pair combination 1 and 3.

FIGS. 13–14C show a cross-section of a plug housing 120 having eight lead frames 124 at positions designated P1–P8 arranged in two planar arrays, each lead frame 124 includes an integral plug interface blade 122. An IDC 126 is coupled to each lead frame 124 and a respective wire is connected to each IDC 126. In this embodiment, an electrically conductive material 128 is connected to lead frame 124 at position P3 in the lower plane and extends obliquely through the body of the plug 120 over a length portion of and at a distance from the lead frame 124 at position P5 in the upper plane. A substrate of insulating material 130 is arranged between the electrically conductive material 128 and the lead frame 124 at position P5 so that the electrically conductive material 128 is not electrically connected to the lead frame 124 at position P5. By means of this construction, compensation capacitance is developed between the lead frames 124 at positions P3 and P5 thereby improving TOC performance measured between the pair combination 1 and 3.

The plugs described with respect to FIGS. 5–7 and 11–14C may be used to terminate an end of a multi-wire cable whereby the other end of the cable is terminated by a similar plug or another modular connector. A plug-cable assembly is thus formed.

The embodiment of a plug in accordance with the invention described above provides consistent TOC performance. However, as telecommunications develop, it is also beneficial to have consistent overall NEXT performance in plugs, whether Category 5, Category 5E or Category 6 plugs A second embodiment of a plug in accordance with the invention is shown in FIGS. 18–26 and provides consistent TOC performance and NEXT performance. In this embodiment, plug 140 includes a housing 142 made of dielectrical material and a load bar 144. Housing 142 has the dimensions of a standard RJ45 plug and includes a latch 146 projecting from a lower surface 148. Housing 142 also includes parallel, spaced, longitudinal extending terminal-receiving slots 150 formed in an upper surface 152 at a front end of the housing 142 and a longitudinal cavity 154 extending from a rear face 156 of the housing 142 inward to a location below the terminal-receiving slots 150. A rearward portion 158 of the cavity 154 has a substantially rectangular cross-section while a forward portion 160 of the cavity 154 is constructed so that it is adapted to receive the forward end 172 of the load bar 144 having the conductors or wires of a cable terminated by the plug inserted thereon. The load bar 144 is preferably substantially longitudinally coextensive with the cavity 154. The rearward portion 158 of the cavity 154 tapers inward from the rear face 156. A strain relief element 164 extends from an upper surface 152 of housing 142 and has a lower surface extending close to or in the rearward portion 158 of the cavity 154.

Figure 22:
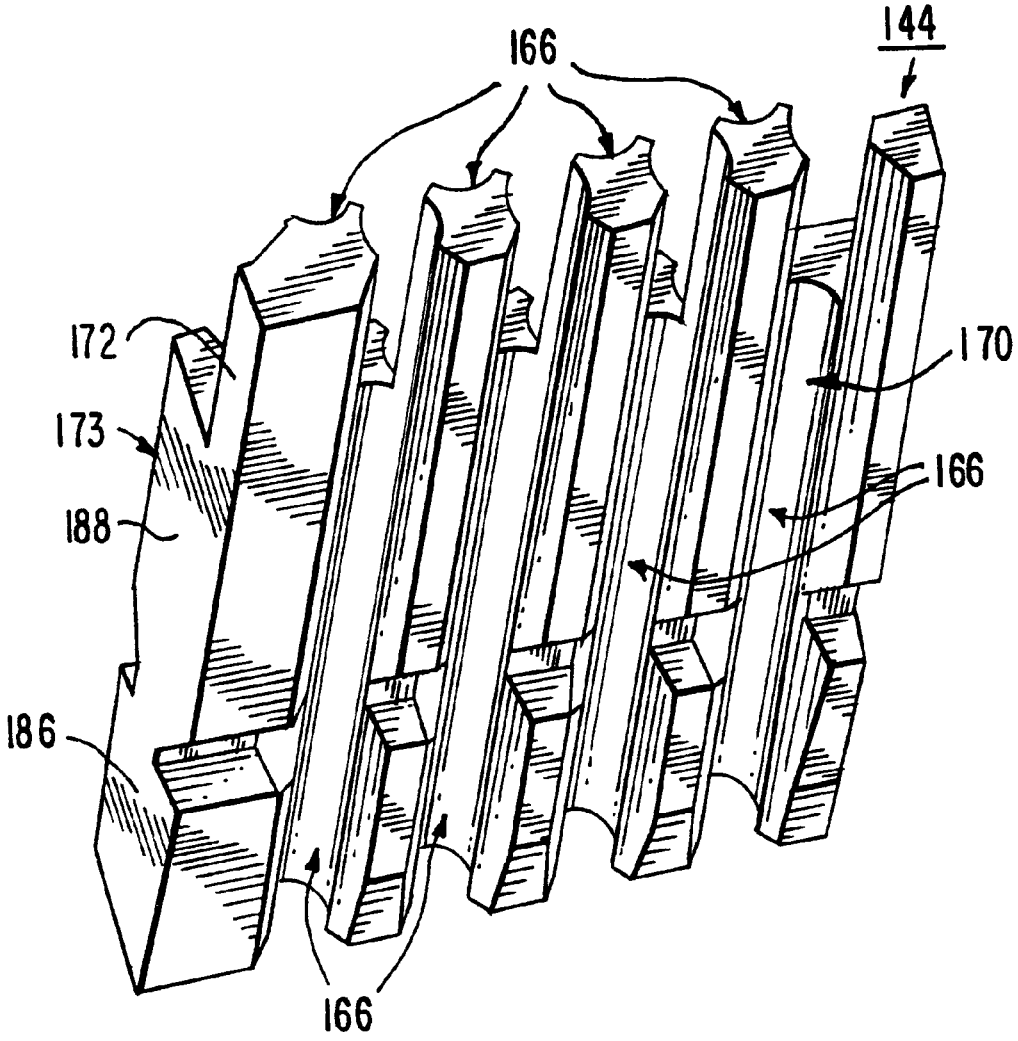
FIG. 22 is a perspective view of the load bar of the plug of FIG. 18.
Figure 23:
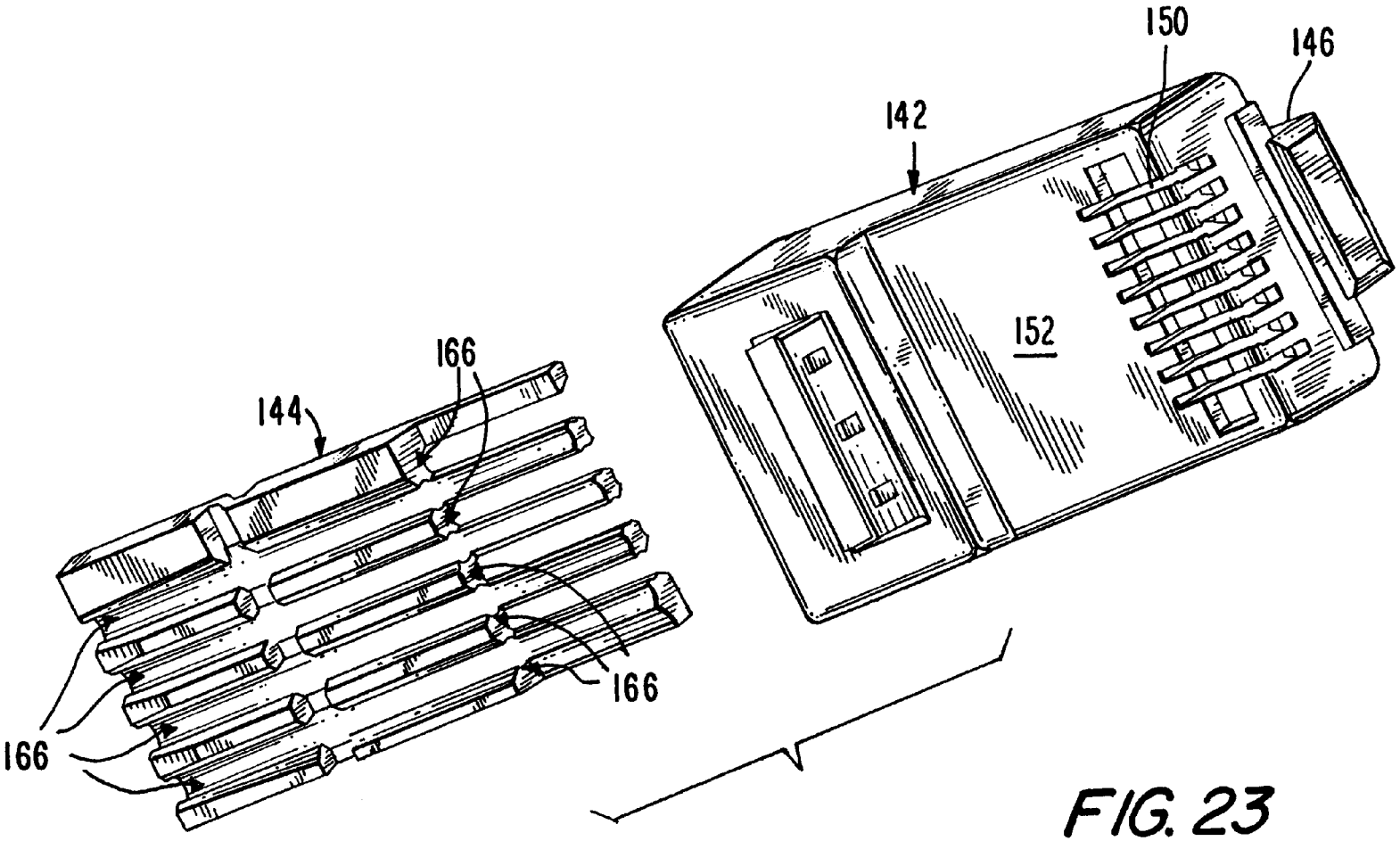
FIG. 23 is another exploded perspective view of the plug of FIG. 18.

Load bar 144 is made of a dielectric material and includes wire-receiving channels 166, four channels in each of two rows in the illustrated embodiment. The channels 166 are staggered in relation to one another and are dimensioned to receive different-sized wires. The channels 166 are open in order to facilitate easy insertion of the wires 168 and constructed to facilitate secure retention of the wires 168 in the channels 166. More specifically, each channel 166 is formed by a longitudinally extending, arcuate surface 170 which forms a cradle receivable of a wire 168 (FIG. 22). Projections 171 are thereby formed between adjacent channels 166. The projections 171 formed between the channels 166 in the lower row are truncated before the forward edge of the load bar 144 to thereby form a sort of step in a forward end 172 of the load bar 144 in which the channels 166 in the lower row are defined by an underlying surface and the channels 166 in the upper row are defined by opposed side surfaces.

Figure 26:
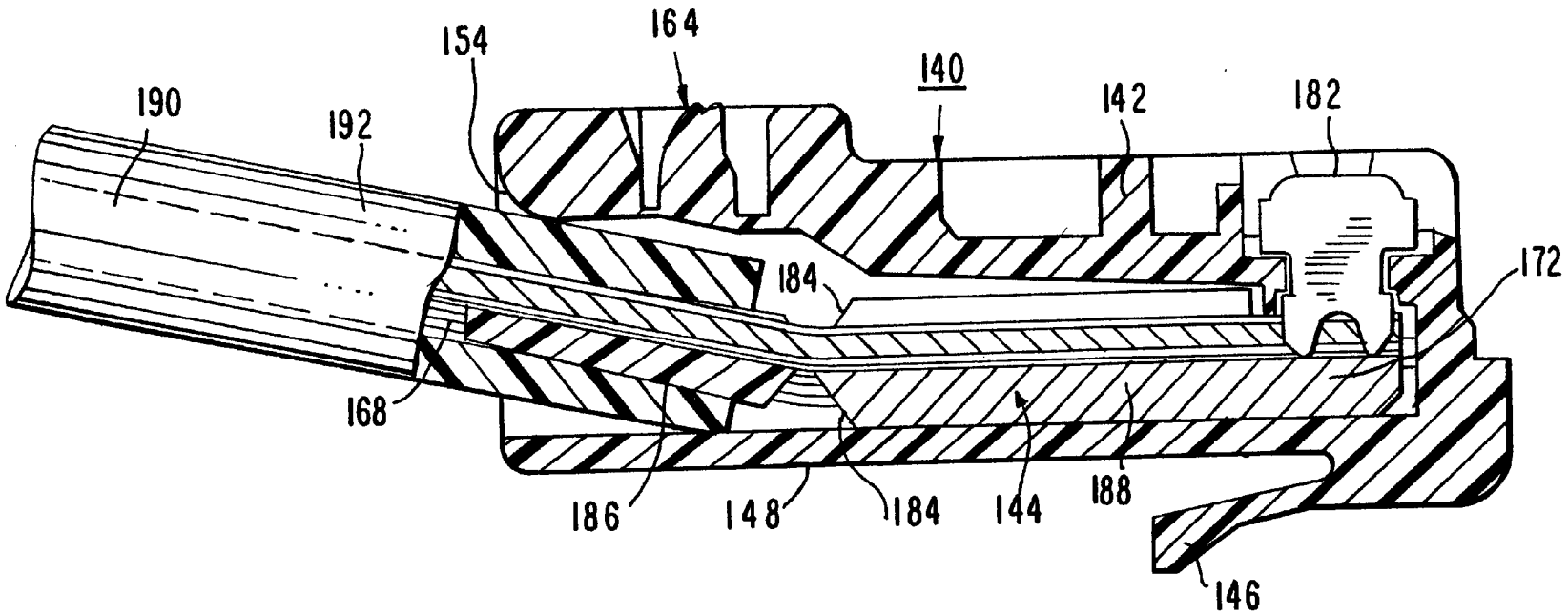
FIG. 26 is a longitudinal cross-sectional view of the assembled plug shown in FIG. 18.

The forward end 172 of the load bar 144 is dimensioned to allow for complete insertion into the forward portion 160 of the cavity 154 and the rear end 173 of the load bar 152 is dimensioned to allow for complete insertion into the rearward portion 158 of the cavity 154. The forward portion 160 of the cavity 154 thus provides opposed upper and lower surfaces 174,176 along which the wires 168 in the lower row slide during insertion of the load bar 144 into the plug housing 142 until they abut against the front end of the cavity 154, and opposed side surfaces 178 and an upper surface 180 along which the wires 168 in the upper row slide during insertion of the load bar 144 into the plug housing 142 until they abut against the front end of the cavity 154 (FIG. 26). The upper surfaces 176,180 include a slit therein through which the contact terminals 182 pass in order to pierce the wires 168 (see FIG. 26).

An important feature of the load bar 144 is that it includes a "hinge" to enable rotational movement of a rearward portion of the load bar 144 relative to a forward portion. This movement may be realized once the load bar 144 is inserted into the cavity 154 and the forward portion thereof fixed within the cavity 154. More specifically, the load bar 144 includes aligned transverse slits 184 in the projections 171 and in the edge portions 145 on both sides. The presence of slits 184 allows the rear portion 186 of the rear end 173 of the load bar 144 to flex with respect to the front portion 188 of the rear end 173 and the front end 172 of the load bar 144. The flex is necessary for reasons discussed below.

By means of the load bar 144, the entire portion of each of the wires 168 within the plug housing 142 is positioned in a precise, predetermined position, including at the location below the strain relief element 164. In this manner, a random arrangement of any portion of the wires 168 within the plug 140 is avoided. The position of the portion of each of the wires 168 which is to be engaged by the terminals 182 is also in a pre-determined position. At a minimum, in a plug in accordance with the invention, it is desirable that the portion of the wires between the location below the strain relief element 164 and the terminals 182 is fixed in position.

Figure 24:
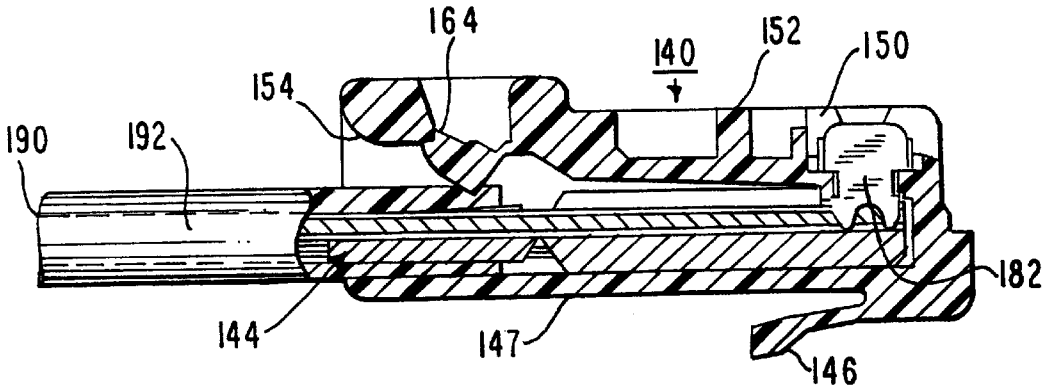
FIG. 24 is a schematic view of the plug of FIG. 18 terminating a multi-wire cable.
Figure 25:
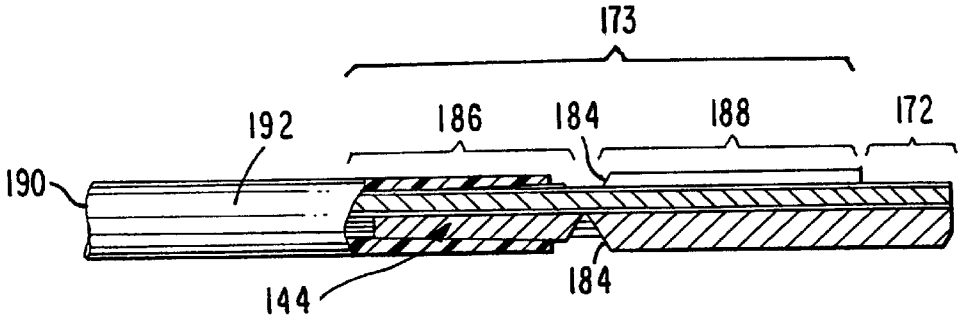
FIG. 25 is a schematic view of the terminated cable prior to insertion into the plug of FIG. 18.

To enable fastening of a cable 190 in connection with the plug 140 vis-a-vis the strain relief, as shown in FIGS. 24–26, a portion of the cable jacket or sheath 192 of the cable 190 overlies the rear portion 186 of the rear end 173 of the load bar 144. This is enabled by slitting the cable jacket 192 a distance at least as large as the length of the wires 168 required to terminate the cable 190 by the plug 140 and then cutting the slit portion of the cable jacket 192 leaving a sufficient amount of the cable jacket 192 to extend above and below the rear portion 186 of the rear end 173 of the load bar 144 about up to the slits 184. The slits 184 are formed on the load bar 144 at a location so that the strain relief element 164 is situated between the rear end of the load bar 144 and the slits 184.

To terminate the cable 190 by means of the plug 140, two opposed longitudinal slits are made in the cable jacket 192 to expose a length of the wires 168 at least as large as the length of the load bar 144. The wires 168, which are usually in twisted pairs in the cable, are untwisted and pressed into the channels 166 in the load bar 144 in correspondence with the designation of the wires 168, as in the conventional manner. The ends of the wires 168 extending beyond the load bar 144 are then cut flush with the front end of the load bar 144. The slit portions of the cable jacket 192 are cut to extend only up to the slits 184 as shown in FIG. 25. The load bar 144 having the slit portions of the cable jacket 192 alongside it is then inserted into the cavity 154 in the housing 142 until the front end of the load bar 144 abuts against the front end of the cavity 154 (FIG. 26). Since the cavity 154 is dimensioned to receive the load bar 144 without clearance below the load bar 144, and with some clearance above the load bar 144, upon insertion of the load bar 144 into the cavity 154, the slit portion of the cable jacket 192 below the load bar 144 causes an upward flex of the rear portion 186 of the rear end 173 of the load bar 144, which flexure is enabled by the slits 184 (FIG. 26). The terminals 182 in the terminal-receiving slots 150 in the housing 142 (see FIGS. 24 and 26) are then pressed into the wires 168 to pierce the insulation of the wires 168 and engage the metal cores therein. The terminals 182 may be pre-positioned in the slots 168 so that it is only necessary to press them into the wires 168.

Thereafter, the strain relief element 164 is pressed inward or set to engage the slit portion of the cable jacket 192 overlying the rear portion of the load bar 144 to thereby secure the cable 190 in connection with the plug 140 (see FIG. 24). The pressing of the strain relief element 164 inward causes the rear portion 186 of the rear end 173 of the load bar 144 to be pressed downward against the lower surface of the cavity 154 thereby reducing the angle between the rear portion 186 of the rear end 173 and the front portion 188 of the rear end 173 and front end 172 (compare FIG. 26 to FIG. 24). The rear portion 186 is not planar with the front portion 188 in view of the presence of the cable jacket between the rear portion 186 ad the lower surface of the cavity 154.

The positioning of the wires 168 in pre-determined positions below the strain relief element 164 reduces variations in NEXT and TOC values between plugs having the same construction. In conventional plugs in which the wires are randomly arranged at the location below the strain relief element, when the strain relief element is pressed inward into the cable, the wires in the cable remain in this random arrangement and even more so, the wires are susceptible to additional random movement. This random arrangement of wires results in inconsistent NEXT and TOC values for plugs having the same design.

A particular advantage of the construction of the plug housing 142 and load bar 144 in accordance with the invention is that cables having different thicknesses of jackets and different diameter wires can be terminated by the plug 140. For the wires, the channels 166 are provided with a size equal to or larger than a relatively large diameter wire so that smaller diameter wires could also be positioned therein. For the different thicknesses of jackets, the height of the rearward portion 158 of the cavity 154 is provided with a size greater than the height of the load bar 144 and twice the thickness of the jacket of a relatively large cable. As such, cables with smaller cable jackets and insulation sheaths can be used to surround the load bar whereby the strain relief element 164 would engage with the upper portion of the cable jacket and thereby fix the cable in connection withe plug 140.

The plug described above in FIGS. 18–26 may be used to terminate an end of a multi-wire cable whereby the other end of the cable is terminated by a similar plug or another modular connector. A plug-cable assembly is thus formed.

With reference to FIGS. 27–29, FIG. 27 shows a chart of de-embedded NEXT values and TOC values for samples of a plug having a similar construction to that shown in FIGS. 18–26. The plug as tested included two load bars of the same type as used in the tests of an RJ45 plug, the results of which are set forth in FIGS. 15–17 (only one load bar was used in those tests whereby the cable was engaged by the strain relief element). In the plug having two load bars, the second load bar was placed adjacent the first load bar, which in a conventional manner was positioned at the front of the cavity below the terminal-receiving slots, and so that the strain relief element would engage a slit cable jacket above this second load bar. It is believed that this construction, although different than the construction of a plug described above with respect to FIGS. 18–26, has NEXT and TOC performance substantially the same as a plug in accordance with the invention.

The plugs as tested terminate a Berk-Tek Hyper-Grade Cat 5 UTP Patch Cable. FIG. 28 is a table of the maximum, minimum and variation in de-embedded NEXT values for tests performed on the twelve different plugs. It can be seen that the variation in NEXT values (delta) ranges between any two wire pairs is from 1.36 dB to 4.94 dB. FIG. 29 is a table of maximum, minimum and variation in TOC values for the same plugs. As shown in FIG. 29, the variation in TOC values (delta) ranges between any two wire pairs is from 2.07 dB to 6.21 dB. These variations are significantly less than the variations in the RJ45 plug, the test results for NEXT and TOC values of which are set forth in FIGS. 15–17 (discussed above).

Figure 30:
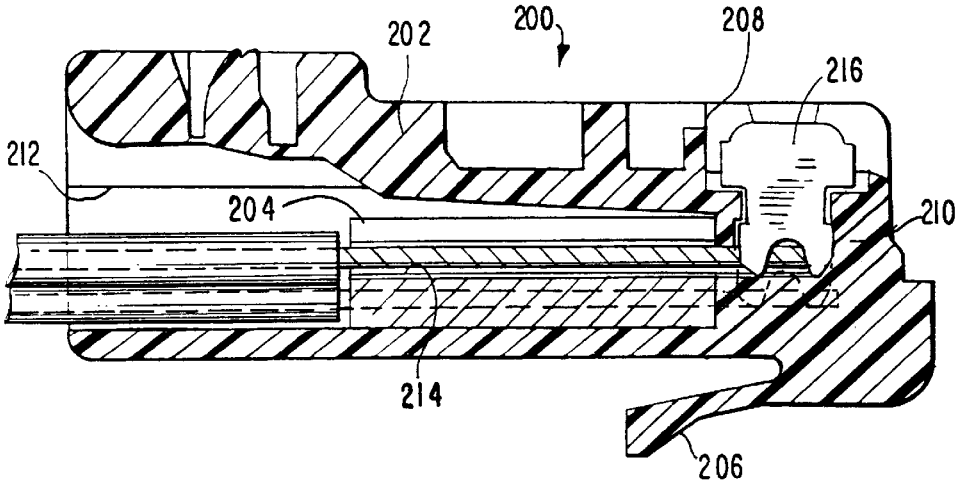
FIG. 30 is a cross-sectional view of a plug including a load bar in accordance with another embodiment of the invention.
Figure 31:
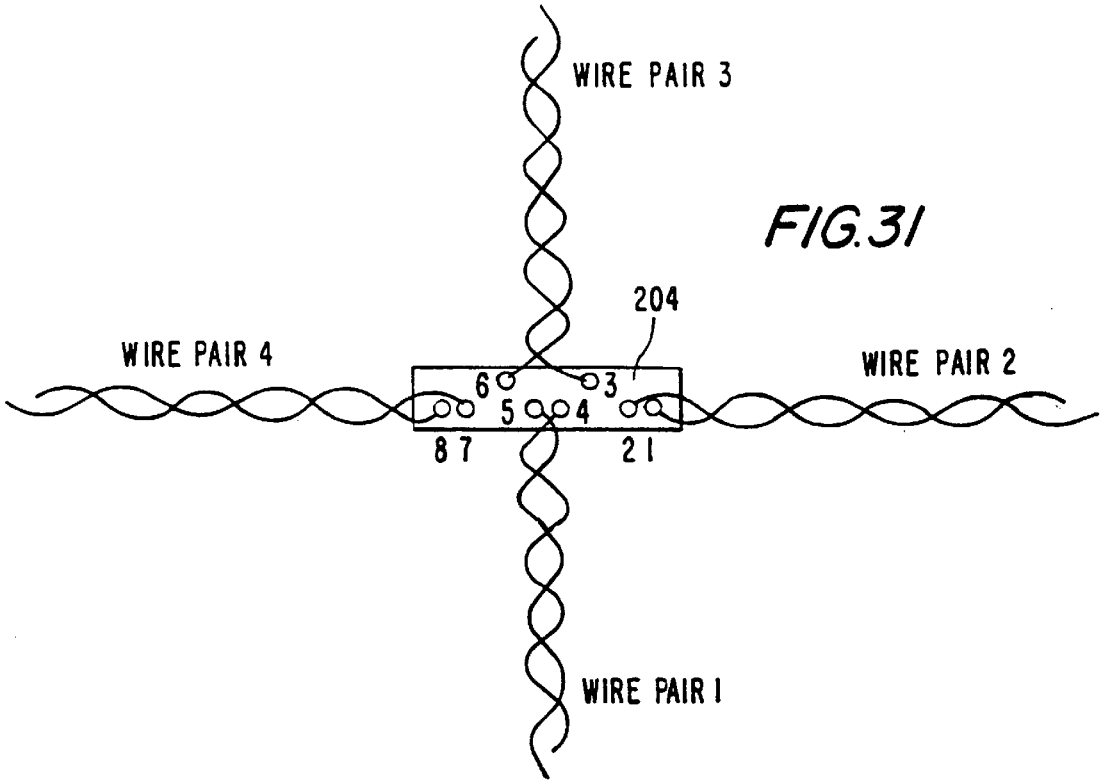
FIG. 31 is an view of the rear end of the plug of FIG. 30 in a condition where it terminates wires.

Another embodiment of a modular plug having a load bar and exhibiting improved NEXT performance will be described with reference to FIGS. 30–33. In this embodiment, the plug 200 includes a housing 202 made of dielectric material and a load bar 204 (FIG. 30). Housing 202 includes a latch 206 projecting from a lower surface, parallel, spaced-apart, longitudinally extending terminal-receiving slots 208 formed in an upper surface at a front end, wire-receiving channels 210 formed at the front end and a longitudinal cavity 212 extending from a rear face inward up to the channels 210. Each channel 210 communicates with a respective slot 208 and the cavity 212 communicates with all of the channels 210. Cavity 212 is constructed to receive the load bar 204. Channels 210 are arranged in a specific pattern, as discussed below.

Figure 32:
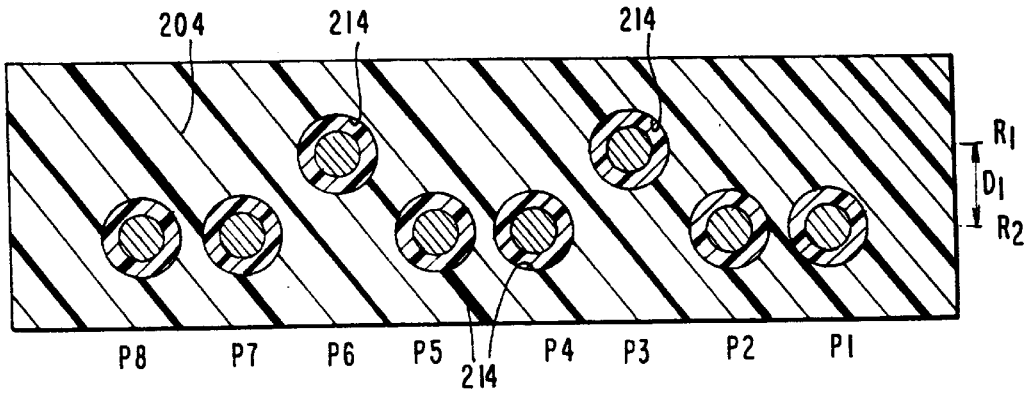
FIG. 32 is a first cross-sectional view of the load bar shown in FIG. 31.

The load bar 204 is formed with eight conductor-receiving channels 214 arranged in a specific manner to provide improved NEXT performance. Specifically, two channels are arranged in an upper, substantially planar row designated R1 and six channels are arranged in a lower, substantially planar row designated R2 whereby the channels 214 in the upper row are those at positions 3 and 6 and thus the channels 214 in the lower row are those at positions 1, 2, 4, 5, 7 and 8 (FIG. 32). The rows R1 and R2 are substantially parallel to one another and preferably parallel to the planar, parallel upper and lower faces of the load bar 214. Channels 214 are also preferably substantially coaxial with channels 210 in the housing 202.

To terminate a cable 218, an end of the cable 218 is unsheathed, the twisted wire pairs are separated and inserted into a rear of the corresponding channels 214 in the load bar 204. The wires are pushed forward in the load bar 204 until a portion thereof extends from the front end of the load bar 204. The wires are then cut off flush with the front face of the load bar 204 and then the load bar 204 is inserted into the cavity 212 in the housing 202. The wires are then urged forward such that a portion thereof enters into the channels 210 in the housing 202. Contact terminals 216, which may be pre-loaded in the slots 208 of the housing 202, are then pushed downward into the wires lying in the channels 210 and pierce the insulation thereof to engage with the conductive core and thereby form an electrical connection. A strain relief element 220 on the housing 202 is then pressed into a portion of the cable 218 within the cavity 212 to secure the same to the housing 202.

Once the wires of the cable 218 are threaded onto the load bar 204, the separation between the wires at positions 3 and 6 and those at the remaining positions results in a reduction in crosstalk.

It has been found that the NEXT value for the wire pairs 45 and 36 (1 and 3) in the plug 200 having a load bar 204 with channels 214 arranged as shown in FIG. 32 is 33.69 dB which is better than the NEXT value for the same wire pairs in plugs with conventional load bars.

Figure 33:
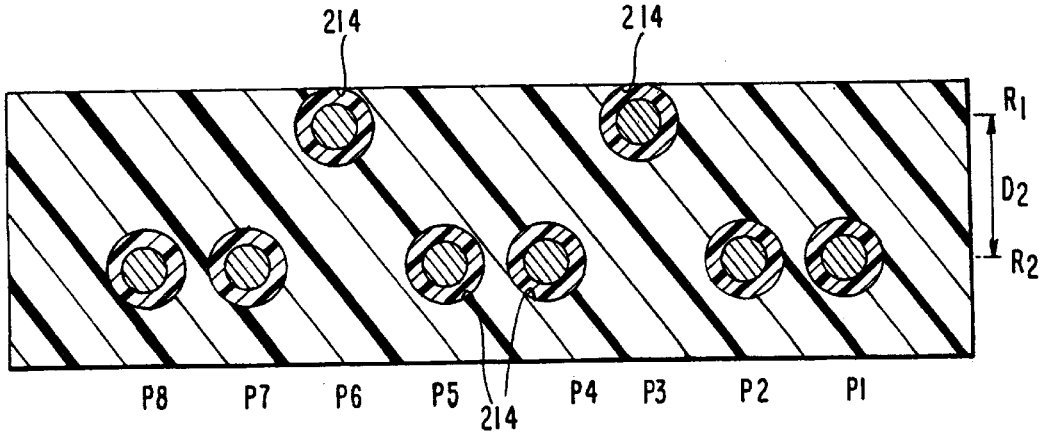
FIG. 33 is a second cross-sectional view of the load bar shown in FIG. 31.

FIG. 33 shows a second cross-sectional view of a load bar for use in plug 200 and which is designated 204'. The main difference between load bar 204' and load bar 204 is that the channels 214 at positions 3 and 6 are spaced at a larger distance from the row R2 in which the channels 214 at positions 1, 2, 4, 5, 7 and 8 are situated such that the wires at positions 3 and 6 are further separated from the wires at positions 1, 2, 4, 5, 7 and 8 (D2>D1).

Although two rows of channels are shown in the load bar, it is possible to arranged the channels in more than two rows, so long as the channels which receive wires operatively forming one circuit pair are situated in the same row which is different than the row(s) in which other wires are situated.

It has been found that the NEXT value for the wire pairs 45 and 36 (1 and 3) in the plug 200 having the load bar 204' with channels 214 arranged as shown in FIG. 33 is 36.21 dB which is better than the NEXT value for the same wire pairs in plugs with conventional load bars. Also, it has been found that the separation distance between the planes in which the wires are situated affects the NEXT performance.

This positioning of wire-receiving channels in a load bar and the corresponding position of channels in a plug as shown in FIGS. 32 and 33 may be used in conjunction with the any of the load bars and plugs described herein as well in numerous other load bars and plugs. For example, the wire-receiving channels of the load bar shown in FIGS. 5–7 may be arranged as shown in FIGS. 32 and 33.

Although the load bar shown in FIGS. 32 and 33 includes eight channels, other load bars having a different number of channels could also be used applying the principles of the invention as described above.

Obviously, numerous modifications and variations of the present invention are possible in light of the above teachings. Accordingly, it is understood that other embodiments of the invention are possible in the light of the above teachings. For example, with respect to the embodiment in FIGS. 18–26, it is pointed out that the disclosed unitary load bar is only one way to ensure a pre-determined positioning for the wires below the strain relief element. Other ways for maintaining the wires in predetermined, fixed positions in the area below the strain relief element are also contemplated to be within the scope and spirit of the invention. Also, the load bar which is substantially coextensive with the cavity in the plug housing is a preferred embodiment. To obtain some of the advantages of the invention, the load bar should extend at least opposite the strain relief element so that the wires positioned on the load bar are in fixed, set positions below the strain relief element thereby avoiding randomness in the organization of the wires in the plug. As such, the load bar need not necessarily be coextensive with the cavity in the plug.

We claim:

1. A modular plug for terminating a multi-wire cable, comprising:

a housing defining a plurality of terminal-receiving slots and a longitudinal cavity extending from a rear surface of said housing to a location below said slots and being in communication with said slots, said cavity having a rearward portion adjacent to said rear surface and a forward portion adjacent to said slots, said housing including a strain relief element extending in the rearward portion of the cavity for engaging with the cable and securing the cable to said housing, contact terminals arranged in said slots, and a load bar defining a plurality of wire-receiving channels for receiving wires of the cable, said load bar being arranged in said cavity, wherein at least a part of the load bar is opposite said strain relief element such that the wires of the cable are fixed in position at least at a location opposite said strain relief element and said load bar including transverse slits arranged between said forward portion of said load bar and said rearward portion of said load bar such that said rearward portion of said load bar is flexible with respect to said forward portion of the load bar.

2. The plug of claim 1, wherein said load bar is unitary.

3. The plug of claim 1, wherein said load bar is substantially coextensive with said cavity.

4. The plug of claim 1, wherein said channels in said load bar are arranged such that each of said channels is in communication with one of said slots.

5. The plug of claim 1, wherein said load bar is constructed such that two parallel rows of at least two of said channels are formed, said channels being staggered in relationship to one another.

6. The plug of claim 1, wherein said load bar is constructed such that said channels extend to a location opposite said slots.

7. A modular plug for terminating a multi-wire cable, comprising:

a housing defining a plurality of terminal-receiving slots and a longitudinal cavity extending from a rear surface of said housing to a location below said slots and being in communication with said slots, said cavity having a rearward portion adjacent to said rear surface and a forward portion adjacent to said slots, said housing including a strain relief element extending in the rearward portion of the cavity for engaging with the cable and securing the cable to said housing, contact terminals arranged in said slots, and a load bar defining a plurality of wire-receiving channels for receiving wires of the cable, said load bar being arranged in said cavity, wherein at least a part of the load bar is opposite said strain relief element such that the wires of the cable are fixed in position at least at a location opposite said strain relief element and said load bar being hinged such that said rearward portion of said load bar is rotatable with respect to said forward portion of said load bar.

8. The plug of claim 7, wherein said rearward portion of said load bar is arranged opposite said strain relief element such that pressing of said strain relief element causes rotation of said rearward portion of said load bar with respect to said forward portion of said load bar.

9. A modular plug for terminating various multi-wire cables having different sizes, comprising:

a housing defining a plurality of terminal-receiving slots arranged and a longitudinal cavity extending from a rear surface of said housing to a location below said slots and being in communication with said slots, said housing including a strain relief element for engaging with the cable and securing the cable to said housing, contact terminals arranged in said slots, and a load bar defining a plurality of wire-receiving channels for receiving wires of the cable, said load bar having a size relative to said cavity such that a rearward portion of said load bar is movable within said cavity, said load bar being hinged such that a rearward portion of said load bar is rotatable with respect to a forward portion of said load bar.

10. The plug of claim 9, wherein said load bar is arranged in said cavity opposite said strain relief element such that the wires of the cable are fixed in position at least at a location opposite said strain relief element.

11. The plug of claim 9, wherein said load bar includes transverse slits arranged between the forward portion of said load bar and the rearward portion of said load bar.

12. The plug of claim 9, wherein said load bar is constructed such that two parallel rows of at least two of said channels are formed, said channels being staggered in relationship to one another.

13. A modular plug-cable assembly, comprising:

a multi-wire cable including a cable jacket, and at least one plug terminating a respective end of said cable, each of said at least one plug comprising a housing defining a plurality of terminal-receiving slots and a longitudinal cavity extending from a rear surface of said housing to a location below said slots and being in communication with said slots, said housing including a strain relief element, a load bar arranged in said cavity and defining a plurality of wire-receiving channels, an end of each of said wires of said cable being arranged in a respective one of said channels, a portion of said load bar being arranged opposite said strain relief element, said cable jacket of said cable being arranged to cover said portion of said load bar arranged opposite said strain relief element, and contact terminals situated in said slots and in engagement with said wires of said cable arranged in said channels, said strain relief element engaging with said cable at a location at which said cable jacket of said cable covers said load bar such that said strain relief element secures said cable to said housing and said wires of said cable are fixed in position at said location.

14. The assembly of claim 13, wherein said at least one plug comprises first and second plugs for terminating respective first and second ends of said cable.

15. The assembly of claim 13, wherein said load bar includes transverse slits arranged between a forward portion of said load bar and a rearward portion of said load bar such that said rearward portion of said load bar is flexible with respect to said forward portion of the load bar.

16. The assembly of claim 13, wherein said load bar is constructed such that two parallel rows of at least two of said channels are formed, said channels being staggered in relationship to one another.

17. The assembly of claim 13, wherein said load bar is constructed such that said channels extend to a location opposite said slots.

18. The assembly of claim 13, wherein said cable includes a cable jacket, a portion of said cable jacket overlying a rear portion of said load bar and another portion of said cable jacket underlying said rear portion of said load bar, said rear portion of said load bar being positioned opposite said strain relief element such that said strain relief element engages said portion of said cable jacket overlying said rear portion of said load bar.

19. The assembly of claim 13, wherein said load bar is hinged such that a rearward portion of said load bar is rotatable with respect to a forward portion of said load bar.

20. The assembly of claim 19, wherein said rearward portion of said load bar is arranged opposite said strain relief element such that pressing of said strain relief element causes rotation of said rearward portion of said load bar with respect to said forward portion of said load bar.

21. A method for terminating a multi-wire cable with a plug, comprising the steps of:

slitting a cable jacket of the cable to expose a length of the wires at least as long as the length of a load bar adapted to enter into a cavity of a housing of the plug, inserting the wires into channels in the load bar, removing a portion of the slit cable jacket from the cable such that a remaining portion of the cable jacket overlies and underlies a rearward portion of the load bar, inserting the load bar into the cavity in the housing of the plug such that the wires are brought into alignment with terminal-receiving slots in the housing of the plug and the overlying portion of the cable jacket extends beyond a strain relief element of the housing of the plug, pressing terminals disposed in the slots into engagement with the wires, and thereafter crimping the strain relief element to engage the overlying portion of the cable jacket to thereby secure the cable to the housing of the plug.

22. The method of claim 21, wherein the wires are inserted into the channels in the load bar such that a portion of each wire extends beyond a front edge of the load bar, further comprising the step of:

removing the portion of the wires extending beyond the front edge of the load bar.

23. The method of claim 21, wherein the portion of the slit cable jacket underlying the load bar extends beyond the strain relief element.

* * * * *